US011072061B2

(12) United States Patent
Takeuchi et al.

(10) Patent No.: US 11,072,061 B2
(45) Date of Patent: Jul. 27, 2021

(54) ROTARY TOOL

(71) Applicant: MAKITA CORPORATION, Anjo (JP)

(72) Inventors: Hajime Takeuchi, Anjo (JP); Masanori Furusawa, Anjo (JP)

(73) Assignee: MAKITA CORPORATION, Anjo (JP)

( * ) Notice: Subject to any disclaimer, the term of this patent is extended or adjusted under 35 U.S.C. 154(b) by 155 days.

(21) Appl. No.: 16/157,572

(22) Filed: Oct. 11, 2018

(65) Prior Publication Data

US 2019/0118361 A1 Apr. 25, 2019

(30) Foreign Application Priority Data

Oct. 23, 2017 (JP) ..... JP2017-204444

(51) Int. Cl.
*B25D 16/00* (2006.01)

(52) U.S. Cl.
CPC ..... *B25D 16/003* (2013.01); *B25D 16/006* (2013.01); *B25D 2211/003* (2013.01); *B25D 2211/068* (2013.01); *B25D 2216/0023* (2013.01); *B25D 2250/095* (2013.01); *B25D 2250/165* (2013.01); *B25D 2250/221* (2013.01)

(58) Field of Classification Search
CPC ..... B25D 16/003; B25D 16/006; B25D 2211/003; B25D 2211/0023; B25D 2216/0023; B25D 2250/095; B25D 2250/221
USPC ..... 173/2
See application file for complete search history.

(56) References Cited

U.S. PATENT DOCUMENTS 5,456,324 A * 10/1995 Takagi ..... B25D 16/006 173/109
5,584,619 A * 12/1996 Guzzella ..... B23Q 11/04 408/9

(Continued)

FOREIGN PATENT DOCUMENTS

JP 2002-200579 A 7/2002
JP 2005-537945 A 12/2005

(Continued)

OTHER PUBLICATIONS

Apr. 20, 2021 Office Action issued in Japanese Patent Application No. 2017-204444.

*Primary Examiner* — Michelle Lopez
(74) *Attorney, Agent, or Firm* — Oliff PLC

(57) ABSTRACT

A rotary tool includes a motor, a final output shaft, a housing, a detecting mechanism, an interrupting mechanism and a solenoid. The motor includes a motor body and a motor shaft. The final output shaft is configured to be rotationally driven by torque transmitted from the motor shaft. The housing houses the motor and the final output shaft. The detecting mechanism is configured to detect a motion state of the housing. The interrupting mechanism is provided on a transmission path of the torque from the motor shaft to the final output shaft, and configured to interrupt transmission of the torque. The solenoid includes a linearly movable actuation part and is configured to mechanically actuate the interrupting mechanism via the actuation part based on the motion state of the housing detected by the detecting mechanism.

19 Claims, 17 Drawing Sheets

(56) References Cited

U.S. PATENT DOCUMENTS 5,879,111 A * 3/1999 Stock ..... B25D 16/003 408/6
5,954,457 A * 9/1999 Stock ..... B25D 16/003 408/6
5,996,707 A * 12/1999 Thome ..... B25F 5/00 173/171
6,415,875 B1 * 7/2002 Meixner ..... B24B 23/028 173/171
6,700,341 B2 * 3/2004 Schaer ..... B25F 5/00 318/432
6,981,557 B2 * 1/2006 Boeni ..... B25D 11/005 173/1
7,055,620 B2 * 6/2006 Nadig ..... B25D 16/003 173/176
7,422,075 B2 * 9/2008 Hahn ..... B25B 23/141 173/178
7,487,845 B2 * 2/2009 Carrier ..... B25F 5/00 173/176
7,506,694 B2 * 3/2009 Stirm ..... B25F 5/00 173/176
8,905,153 B2 * 12/2014 Braun ..... B25D 16/003 173/4
9,533,406 B2 * 1/2017 Aoki ..... B25D 11/125
2001/0042630 A1 * 11/2001 Kristen ..... B25F 5/00 173/1
2002/0062967 A1 5/2002 Ziegler
2006/0124331 A1 * 6/2006 Stirm ..... F16D 43/208 173/178
2013/0319710 A1 12/2013 Aoki et al.
2015/0279538 A1 10/2015 Toda et al.

FOREIGN PATENT DOCUMENTS

JP 2013-244581 A 12/2013
JP 2015-192098 A 11/2015
WO 2004024398 A1 3/2004

* cited by examiner

ROTARY TOOL

CROSS-REFERENCE TO RELATED APPLICATION

The present application claims priority to Japanese patent application No. 2017-204444 filed on Oct. 23, 2017, the contents of which are fully incorporated herein by reference.

TECHNICAL FIELD

The present disclosure relates to a rotary tool that is configured to rotationally drive a final output shaft. More specifically, the present disclosure relates to a rotary tool that is configured to interrupt torque transmission to the final output shaft when excessive reaction torque acts on a housing of the rotary tool.

BACKGROUND

During an operation of a rotary tool such as a hammer drill, a tool accessory may be locked biting into a workpiece, so that a final output shaft may be brought into a non-rotatable state (also referred to as a locked state or a blocking state). In such a case, excessive reaction torque may act on a housing of the rotary tool. As a result, the housing may be caused to rotate around a rotation axis of the final output shaft. Therefore, a rotary tool is proposed which includes a safety clutch disposed on a torque transmission path from a motor to the final output shaft (for example, Japanese laid-open patent publication No. 2002-200579).

SUMMARY

In a rotary tool disclosed in Japanese laid-open patent publication No. 2002-200579, an electromagnetic clutch is employed as the safety clutch. This electromagnetic clutch is coaxially arranged with a motor shaft and is capable of interrupting torque transmission from the motor shaft to a pinion shaft. However, a more rational structure for interrupting the torque transmission is desired, since the electromagnetic clutch is generally expensive.

Accordingly, it is an object of the present disclosure to provide a technology that may contribute to rationalization of a structure that is configured to interrupt torque transmission to a final output shaft when excessive reaction torque acts on a housing, in a rotary tool.

In one aspect of the present disclosure, a rotary tool is provided which includes a motor, a final output shaft, a housing, a detecting mechanism, an interrupting mechanism and a solenoid.

The motor includes a motor body and a motor shaft. The motor body includes a stator and a rotor. The motor shaft extends from the rotor and is configured to be rotatable around a first rotation shaft. The final output shaft is configured to be rotationally driven around a second rotation axis by torque transmitted from the motor shaft. The housing houses the motor and the final output shaft. The detecting mechanism is configured to detect a motion state of the housing. The interrupting mechanism is provided on a transmission path of the torque from the motor shaft to the final output shaft. The interrupting mechanism is configured to interrupt transmission of the torque. The solenoid includes an actuation part that is linearly movable. Further, the solenoid is configured to mechanically actuate the interrupting mechanism via the actuation part based on the motion state of the housing which is detected by the detecting mechanism.

In the present aspect, the interrupting mechanism which is provided on the torque transmission path from the motor shaft to the final output shaft is mechanically actuated via the actuation part of the solenoid. The solenoid is a cheaper electrical component than an electromagnetic clutch. Further, although the interrupting mechanism itself is disposed on the torque transmission path, there is greater flexibility concerning an arrangement of the solenoid which actuates the interrupting mechanism via the actuation part. Therefore, according to the present aspect, the structure that is capable of interrupting transmission of torque when excessive reaction torque acts on the housing can be more rationally realized than that using an electromagnetic clutch.

Examples of the "rotary tool" according to the present aspect may include a drilling tool that performs a drilling operation by rotationally driving a tool accessory coupled to a final output shaft (typically, a tool holder), a tightening tool that tightens a bolt or a nut which is engaged with a final output shaft (typically, a socket). Particularly, the present aspect may be usefully applied to a rotary tool in which excessive reaction torque may act on a housing during an operation. Examples of such a rotary tool may include a hammer drill, a nut runner and a shear wrench.

The motor may be an alternate current (AC) motor or a direct current (DC) motor. Further, the motor may be a motor with a brush or a so-called brushless motor having no brush. In terms of the fact that it is difficult to apply an electrical brake to an AC motor, the present disclosure may be particularly usefully applied to a rotary tool with an AC motor.

The housing may also be referred to as a tool body. The housing may house a mechanism other than the motor and the final output shaft. Further, the housing may be formed by connecting a plurality of parts (for example, a part for housing the motor and a part for housing the final output shaft). The housing may have a single layer structure or a two-layer structure.

The "motion state of the housing" may typically refer to a state of rotation of the housing around a rotation axis. The motion state of the housing can be suitably used to detect a state in which excessive reaction torque is acting on the housing (in other words, a state in which the housing is excessively rotated around a driving axis) since the motion state of the housing varies corresponding to the magnitude of reaction torque acting on the housing. The detecting mechanism for the motion state of the housing may be realized as a mechanism that is capable of detecting a physical quantity relating to the motion state of the housing. As such a detecting mechanism, for example, an acceleration sensor, a speed sensor and a displacement sensor may be employed.

Typically, the interrupting mechanism is configured to be mechanically actuated via the actuation part of the solenoid to interrupt torque transmission to any shaft disposed on the transmission path from the motor to the final output shaft. Further, the "actuation" of the interrupting mechanism used herein means shifting from a transmittable state, in which the interrupting mechanism is capable of transmitting torque, to an interrupting state, in which the interrupting mechanism is incapable of transmitting torque.

The solenoid is an electrical component which is configured to convert electrical energy into mechanical energy of linear motion by utilizing a magnetic field, which is generated by supplying a current to a coil. The solenoid may also be referred to as a solenoid actuator or a linear solenoid.

In one aspect of the present disclosure, the interrupting mechanism may be configured as a mechanical clutch mechanism that includes a first clutch member and a second clutch member. The interrupting mechanism may be configured to interrupt the transmission of the torque by a movement of the first clutch member from a transmitting position to an interrupting position. The "transmitting position" may refer to a position in which the first clutch member enables transmission of the torque by the first and second clutch members, and the "interrupting position" may refer to a position in which the first clutch member disables transmission of the torque by the first and second clutch members. Further, the solenoid may be configured to move the first clutch member from the transmitting position to the interrupting position via at least one intervening member. The at least one intervening member may be disposed between the actuation part and the first clutch member. An operating direction of the actuation part and a moving direction of the first clutch member may cross each other. In other words, the at least one intervening member may be configured as a motion converting mechanism which is configured to convert linear motion of the actuation part into motion of the first clutch member in a direction which is different from that of the linear motion of the actuation part.

In the present aspect, the interrupting mechanism is configured as a mechanical clutch mechanism including the first clutch member and the second clutch member. The first clutch member may be moved to the interrupting position in a direction crossing the operating direction of the actuation part. Therefore, the solenoid can be disposed in an appropriate position while an increase in the overall size (length) of the clutch mechanism and the solenoid in a certain direction can be prevented. It is noted that the structure of the clutch mechanism is not particularly limited, and the clutch mechanism may be, for example, of an engagement type or a friction type.

In one aspect of the present disclosure, when the solenoid is not in operation, the at least one intervening member may be held in an initial position by a biasing force of at least one torsion spring so that the first clutch member is disposed in the transmitting position. Further, when the solenoid is operated, the actuation part may move the at least one intervening member from the initial position against the biasing force of the at least one torsion spring and thereby move the first clutch member to the interrupting position. According to the present aspect, with a simple structure using the torsion spring, the first clutch member can be held in the transmitting position when the solenoid is not in operation, while the first clutch member can be moved to the interrupting position when the solenoid is operated. Further, when the solenoid is turned from the operating state to the non-operating state, the first clutch member can be returned to the transmitting position by the biasing force of the torsion spring. Further, the use of the torsion coil spring can easily make the operating direction of the actuation part and the moving direction of the first clutch member to be different from each other.

In one aspect of the present disclosure, the rotary tool may further include an intermediate shaft. The intermediate shaft may be disposed between the motor shaft and the final output shaft on the transmission path and may be configured to rotate around a third rotation axis. The clutch mechanism may be provided on the intermediate shaft and configured to interrupt transmission of the torque to the intermediate shaft. In the present aspect, providing the clutch mechanism not on the motor shaft but on the intermediate shaft may provide greater flexibility in designing the clutch mechanism.

In one aspect of the present disclosure, the intermediate shaft may have a first hole and a second hole. The first hole may extend along the third rotation axis of the intermediate shaft. The second hole may extend through the intermediate shaft in a direction crossing the third rotation axis. The clutch mechanism may include the first clutch member, the second clutch member and a ball. The first clutch member may be formed in a shaft-like shape having a large-diameter part and a small-diameter part, and may be disposed to be movable along the third rotation axis within the first hole of the intermediate shaft. The second clutch member may be disposed radially outward of and coaxially with the intermediate shaft. The ball may be disposed within the second hole and between the first clutch member and the second clutch member in a radial direction of the intermediate shaft. When the solenoid is not in operation, the first clutch member may be disposed in the transmitting position in which the large-diameter part faces the ball so that the intermediate shaft and the second clutch member integrally rotate while combined with each other via the ball, thereby transmitting the torque. Further, when the solenoid is operated, the first clutch member may be moved along the third rotation axis to the interrupting position in which the small-diameter part faces the ball so that the second clutch member is allowed to rotate relative to the intermediate shaft, thereby interrupting the transmission of the torque.

According to the present aspect, the transmission of the torque to the intermediate shaft can be interrupted simply by operating the solenoid to linearly move the first clutch member disposed within the intermediate shaft from the transmitting position to the interrupting position along the third rotation axis. Further, the use of the two clutch members (the first and second clutch members) respectively disposed inside and outside the intermediate shaft can suppress a size increase of the clutch mechanism in an axial direction of the intermediate shaft.

In one aspect of the present disclosure, a plurality of such intervening members may be provided. According to the present aspect, the use of a plurality of intervening members in combination may provide greater flexibility in setting a distance between the actuation part and the first clutch member, and in setting the operating direction of the actuation part and the moving direction of the first clutch member. Therefore, the flexibility concerning the arrangement position of the solenoid in the housing can also be increased.

In one aspect of the present disclosure, the first rotation axis of the motor shaft may cross the second rotation axis of the final output shaft. The housing may include a first housing part that houses the motor body and a second housing part that houses the final output shaft. The solenoid may be disposed between the second housing part and the motor body and within a range of a length of the motor shaft in an extending direction of the first rotation axis. The rotary tool of the present aspect is L-shaped such that the motor shaft and the final output shaft are arranged to extend in directions crossing each other. In the rotary tool having such an arrangement, a region that is adjacent to the second housing part and that surrounds (that is radially outward of) a portion of the motor shaft which protrudes from the motor body tends to become a dead space. According to the present aspect, the solenoid can be efficiently disposed by utilizing this region. It is noted that, in the present aspect, typically, the first rotation axis and the second rotation axis may perpendicularly cross each other. However, the first rotation axis and the second rotation axis may obliquely cross each other.

In one aspect of the present disclosure, at least a portion of the solenoid may be housed in a plastic case mounted to the housing. According to the present aspect, the solenoid, which is an electrical component, can be protected from heat and dust.

In one aspect of the present disclosure, the rotary tool may be a hammer drill that is configured to operate according to a selected one of a plurality of operation modes. The rotary tool may include a mode switching mechanism which is provided on the final output shaft and configured to switch according to the selected operation mode between a first state, in which transmission of the torque to the final output shaft is enabled, and a second state in which the torque transmission is disabled. The clutch mechanism may include a portion of the mode switching mechanism. Generally, a hammer drill having a plurality of operation modes is provided with the mode switching mechanism. Therefore, by utilizing a portion of the mode switching mechanism, the clutch mechanism can be realized which is capable of efficiently interrupting torque transmission when excessive reaction torque acts on the housing, while suppressing the number of additional parts.

In one aspect of the present disclosure, the rotary tool may further include a control part configured to control an operation of the rotary tool. The second rotation axis of the final output shaft may extend in a front-rear direction of the rotary tool. The first rotation axis of the motor shaft may cross the second rotation axis. The housing may include a first housing part that houses the motor body and the control part and a second housing part that houses the final output shaft. The control part may be disposed rearward of the motor body within the first housing part, and the solenoid may be disposed rearward of the second housing part. The rotary tool of the present aspect is L-shaped such that the motor shaft and the final output shaft are arranged to extend in directions crossing each other. Therefore, by arranging the control part and the solenoid as described above, a distance between the solenoid and the control part can be relatively shortened while the solenoid is disposed near the clutch mechanism disposed on the final output shaft, thereby facilitating wiring.

In one aspect of the present disclosure, the rotary tool may further include another solenoid. In other words, the rotary tool may include two solenoids. The two solenoids may be configured to move the first clutch member via the at least one intervening member by resultant force of the two solenoids. According to the present aspect, the clutch mechanism can be more reliably actuated by the resultant force of the two solenoids.

DETAILED DESCRIPTION OF THE EMBODIMENTS

Embodiments are explained below, with reference to the drawings.

First Embodiment

A first embodiment is now explained with reference to FIGS. 1 to 11. In this embodiment, a hammer drill 101 is described as an example of a rotary tool. The hammer drill 101 is configured to perform an operation (hereinafter referred to as a drilling operation) of rotationally driving a tool accessory 100 coupled to a tool holder 30 around a prescribed driving axis A1 and an operation (hereinafter referred to as a hammering operation) of linearly driving the tool accessory 100 along the driving axis A1.

Figure 1:
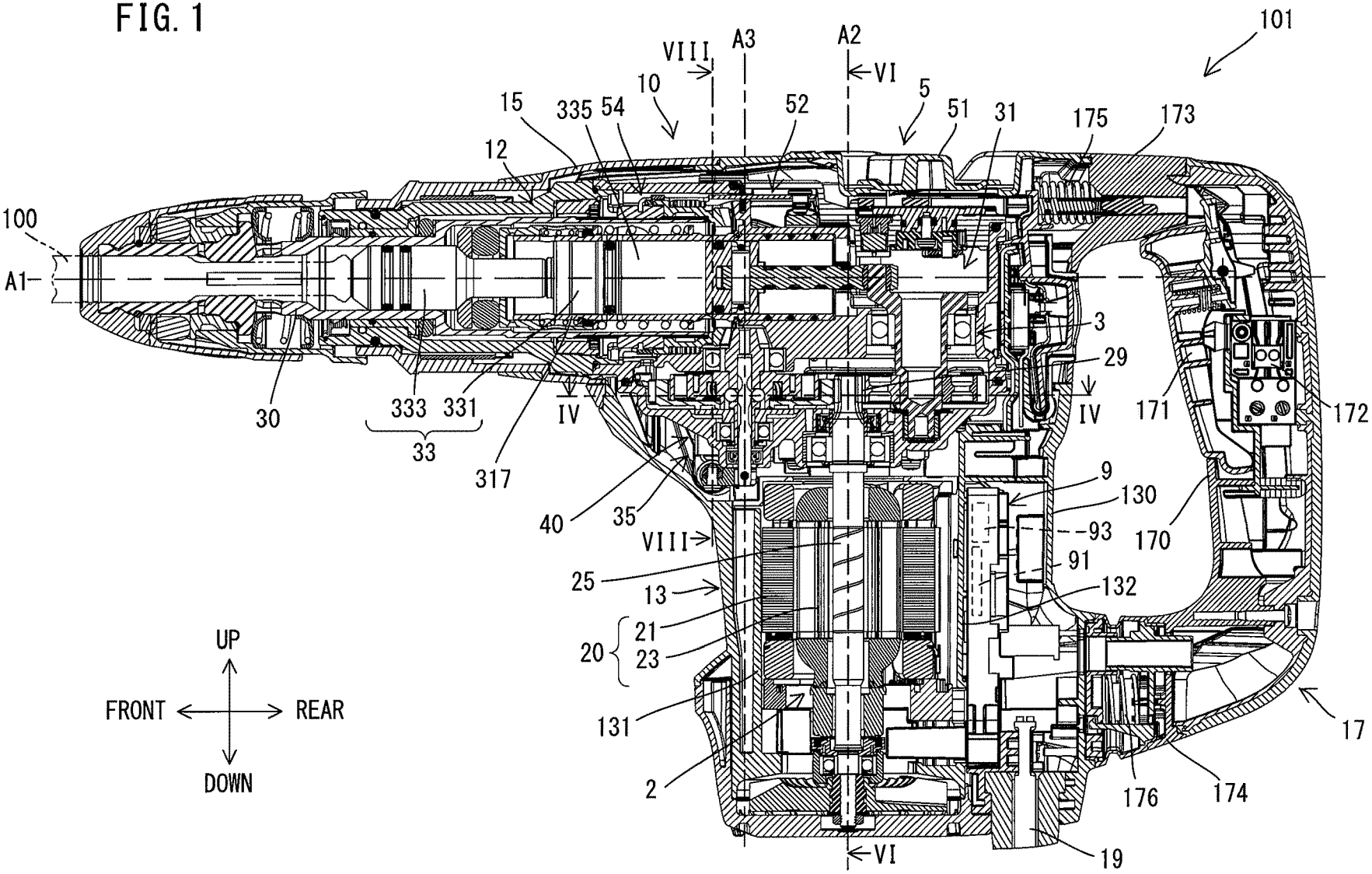
FIG. 1 is a longitudinal section of a hammer drill according to a first embodiment.

First, the overall structure of the hammer drill 101 is briefly explained with reference to FIG. 1. As shown in FIG. 1, the hammer drill 101 includes a body 10 and a handle 17 connected to the body 10.

The body 10 includes a gear housing 12, a motor housing 13 and an outer housing 15. The gear housing 12 extends along the driving axis A1. The motor housing 13 is connected to one end portion of the gear housing 12 in its longitudinal direction, and extends in a direction crossing (more specifically, generally perpendicular to) the driving axis A1. The outer housing 15 covers the gear housing 12. With such a structure, the body 10 is generally L-shaped as a whole. The tool holder 30 is disposed within the other end portion of the gear housing 12 in the longitudinal direction. The tool holder 30 is configured such that the tool accessory 100 is removably attached thereto. Further, a driving mechanism 3 which is configured to rotationally and/or linearly drive the tool accessory 100 is housed in the gear housing 2. A motor 2 is housed in the motor housing 13. The motor 2 is disposed such that a rotation axis A2 of a motor shaft 25 extends in a direction crossing (more specifically, perpendicular to) the driving axis A1.

The gear housing 2 and the motor housing 13 are fixedly (immovably) connected to each other. The gear housing 2 and the motor housing 13 are hereinafter also collectively referred to as a body housing 11.

The handle 17 includes a grip part 170 and connection parts 173, 174. The grip part 170 extends in a direction crossing (more specifically, generally perpendicular to) the driving axis A1. The connection parts 173, 174 protrudes from both longitudinal (axial) end portions of the grip part 170 in a direction crossing (more specifically, generally perpendicular to) the grip part 170. The handle 17 is generally C-shaped as a whole. The handle 17 is connected to an end portion of the body 10 on a side opposite to the tool holder 30 in the longitudinal direction of the body 10. More specifically, the connection parts 173, 174 are respectively connected to the gear housing 12 and the motor housing 13.

The structure of the hammer drill 101 is now described in detail. In the following description, for convenience sake, an extending direction of the driving axis A1 of the hammer drill 101 (the longitudinal direction of the gear housing 12) is defined as a front-rear direction of the hammer drill 101. One end side of the hammer drill 101 on which the tool holder 30 is disposed is defined as a front side (also referred to as a front end region side) of the hammer drill 101, and the other side is defined as a rear side of the hammer drill 101. Further, an extending direction of the rotation axis A2 of the motor shaft 25 is defined as an up-down direction of the hammer drill 101. The direction toward which the motor housing 13 extends from the gear housing 12 is defined as a downward direction, and the opposite direction is defined as an upward direction. Furthermore, a direction which is perpendicular to the front-rear direction and the up-down direction (a direction which is perpendicular to the driving axis A1 as well as to the rotation axis A2) is defined as a left-right direction.

First, the motor housing 13 and its internal configuration are described.

As shown in FIG. 1, the motor housing 13 as a whole has a bottomed cylindrical shape having an open upper end. In this embodiment, the motor housing 13 houses the motor 2 which includes a motor body 20 and the motor shaft 25. The motor body 20 includes a stator 21 and a rotor 23, and the motor shaft 25 extends from the rotor 23. In this embodiment, the motor 2 is an alternate current motor, which is configured to be driven by power supplied from an external power source via a power cable 19. In this embodiment, the motor 2 is housed in a space surrounded by a cylindrical inner wall 131 provided within the motor housing 13. The motor shaft 25, which extends in the up-down direction, is rotatably supported at upper and lower end portions by bearings. The upper end portion of the motor shaft 25 protrudes into the gear housing 12 and a driving gear 29 is provided on this protruding part.

Further, a controller 9 is housed in the motor housing 13. More specifically, the controller 9 is mounted on a rear wall part 132 of the inner wall 131 surrounding the motor 2. The rear wall part 132 is disposed rearward of the motor body 20. In other words, the controller 9 is disposed in a space between the inner wall 131 (the rear wall part 132) and a peripheral wall 130 which forms an outer surface of the motor housing 13.

The controller 9 includes a control circuit 91 and an acceleration sensor 93 which are mounted on a main board. In this embodiment, a microcomputer including a CPU, a ROM and a RAM forms the control circuit 91 for controlling operations of the hammer drill 101. The acceleration sensor 93 is configured to output a signal indicating detected acceleration to the control circuit 91. In this embodiment, the acceleration detected by the acceleration sensor 93 is used as an indicator which indicates a motion state (more specifically, rotation around the driving axis A1) of the body 10 (the body housing 11). Further, the controller 9 is electrically connected via a wiring (not shown) to a solenoid 6 (see FIG. 5) and a switch 172 disposed within the handle 17. In this embodiment, when the switch 172 is turned on, the control circuit 91 of the controller 9 drives the motor 2 according to the rotation speed and the number of strokes which are set via a control dial (not shown). Further, the control circuit 91 is configured to actuate the solenoid 6 based on a detection result of the acceleration sensor 93, which will be described in more detail later.

The gear housing 12 and its internal configuration are now described.

As shown in FIG. 1, the gear housing 12 is immovably connected to the motor housing 13 in a state in which a lower end portion of a rear half of the gear housing 12 is disposed within an upper end portion of the motor housing 13. The gear housing 12 mainly houses the tool holder 30 and the driving mechanism 3. In this embodiment, the driving mechanism 3 includes a motion converting mechanism 31, a striking mechanism 33 and a rotation transmitting mechanism 35. A front half of the gear housing 12 is generally cylindrically shaped along the driving axis A1 and houses the tool holder 30. Most of the motion converting mechanism 31 and most of the rotation transmitting mechanism 35 are housed in the rear half of the gear housing 12.

Figure 2:
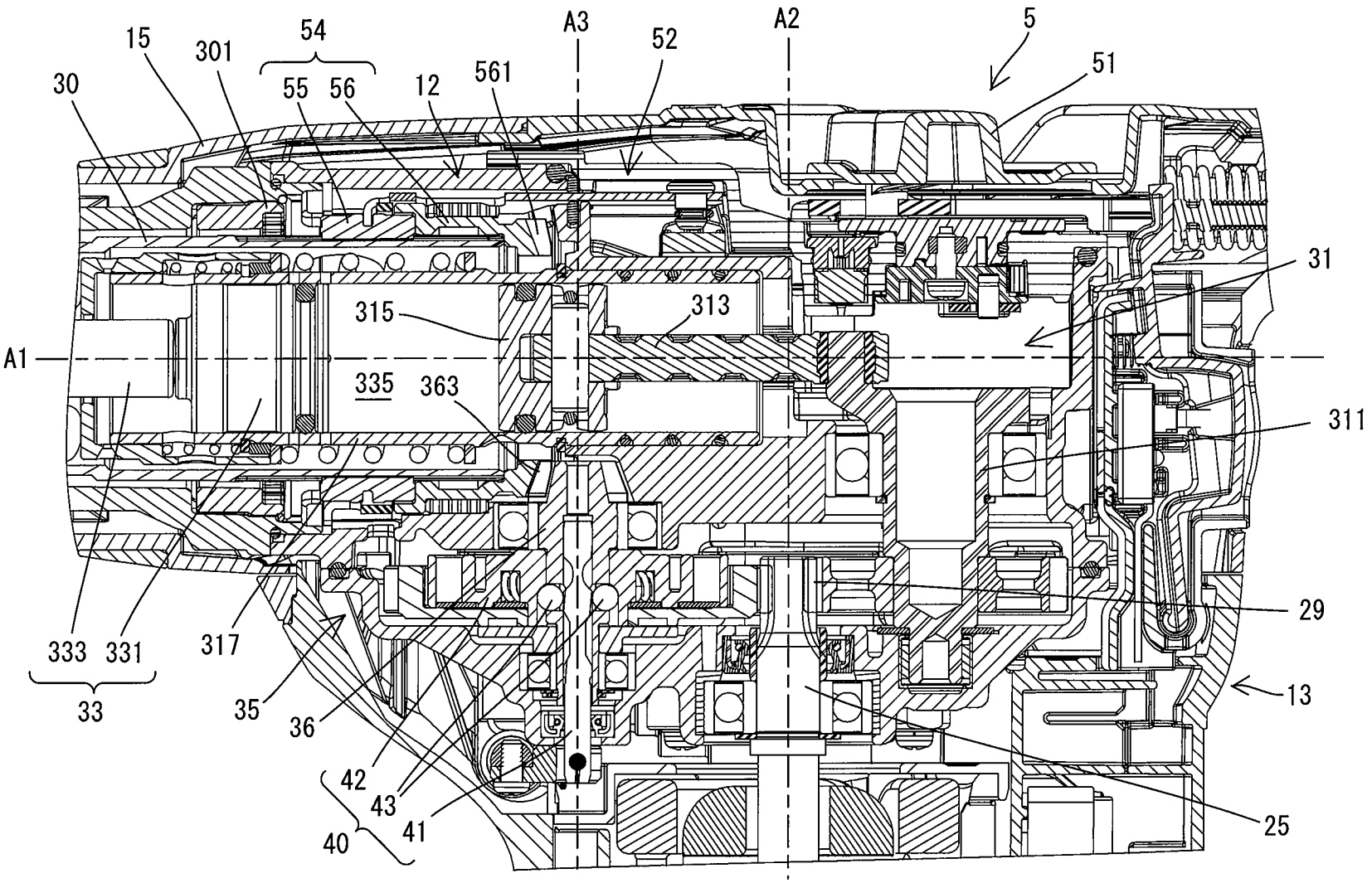
FIG. 2 is a partial enlarged view of FIG. 1.

The motion converting mechanism 31 is configured to convert rotation of the motor shaft 25 into linear motion and transmit it to the striking mechanism 33. As shown in FIG. 2, in this embodiment, a well-known crank mechanism is employed as the motion converting mechanism 31. The motion converting mechanism 31 includes a crank shaft 311, a connecting rod 313, a piston 315 and a cylinder 317. The crank shaft 311 is disposed in parallel to the motor shaft 25 in a rear end portion of the gear housing 12. The crank shaft 311 has a driven gear which is engaged with the driving gear 29, and an eccentric pin. One end portion of the connecting rod 313 is connected to the eccentric pin and the other end portion is connected to the piston 315 via a connecting pin. The piston 315 is slidably disposed within the cylindrical cylinder 317. When the motor 2 is driven, the piston 315 is caused to reciprocate within the cylinder 317 in the front-rear direction along the driving axis A1.

The striking mechanism 33 includes a striker 331 and an impact bolt 333. The striker 331 is disposed in front of the piston 315 so as to be slidable in the front-rear direction along the driving axis A1 within the cylinder 317. An air chamber 335 is formed between the striker 331 and the piston 315. The air chamber 335 serves to linearly move a striking element in the form of the striker 331 via air pressure fluctuations caused by a reciprocating movement of the piston 315. The impact bolt 333 is configured as an intermediate element for transmitting kinetic energy of the striker 331 to the tool accessory 100. As shown in FIG. 1, the impact bolt 333 is disposed within the tool holder 30, which is arranged coaxially with the cylinder 317, so as to be slidable in the front-rear direction along the driving axis A1.

When the motor 2 is driven and the piston 315 is moved forward, air in the air chamber 335 is compressed so that the internal pressure increases. By the action of the air spring, the striker 331 is pushed forward at high speed and collides with the impact bolt 333, thereby transmitting its kinetic energy to the tool accessory 100. As a result, the tool accessory 100 is linearly driven along the driving axis A1 and strikes a workpiece. On the other hand, when the piston 315 is moved rearward, the air in the air chamber 335 expands so that the internal pressure decreases and the striker 331 is retracted rearward. By repeating such operations of the motion converting mechanism 31 and the striking mechanism 33, the hammer drill 101 performs the hammering operation.

The rotation transmitting mechanism 35 is configured to transmit torque of the motor shaft 25 to the tool holder 30, which serves as a final output shaft. As shown in FIG. 2, in this embodiment, the rotation transmitting mechanism 35 includes the driving gear 29 provided on the motor shaft 25, an intermediate shaft 36, a clutch mechanism 40, a small bevel gear 363 and a clutch mechanism 54. The rotation transmitting mechanism 35 is configured as a speed-reducing gear mechanism, and the rotation speeds of the motor shaft 25, the intermediate shaft 36 and the tool holder 30 are reduced in this order.

Figure 3:
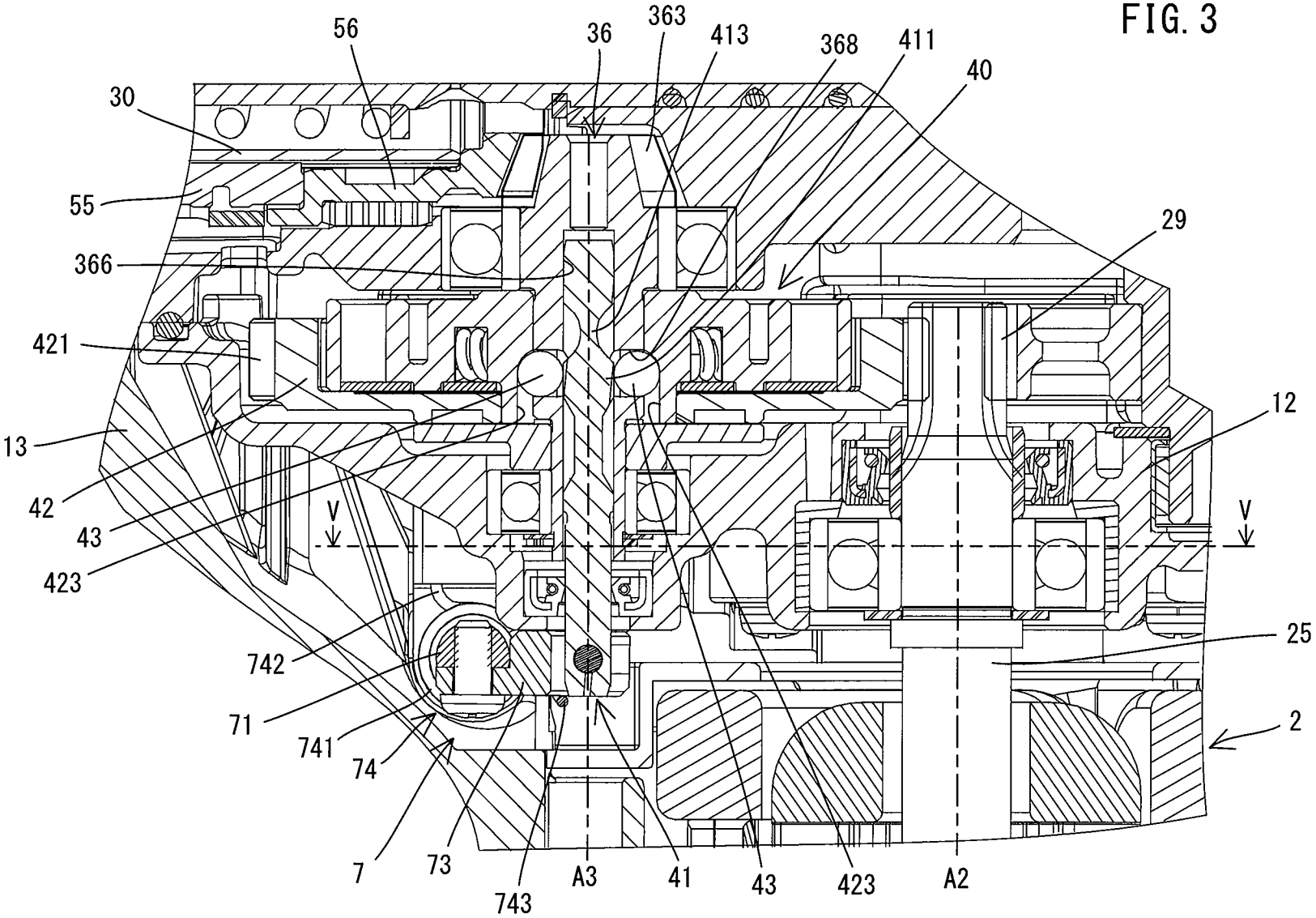
FIG. 3 is a further partial enlarged view of FIG. 2.

As shown in FIGS. 2 and 3, the intermediate shaft 36 is disposed in parallel to the motor shaft 25. More specifically, the intermediate shaft 36 is disposed forward of the motor shaft 25 and supported by two bearings held by the gear housing 12 so as to be rotatable around a rotation axis A3. The rotation axis A3 is parallel to the rotation axis A2. The small bevel gear 363 is provided on an upper end portion of the intermediate shaft 36. Further, the intermediate shaft 36 has a shaft insertion hole 366 and a ball holding hole 368. The shaft insertion hole 366 extends upward from a lower end of the intermediate shaft 36, along the rotation axis A3. The ball holding hole 368 extends through the intermediate shaft 36 in a radial direction, crossing the rotation axis A3. Thus, the ball holding hole 368 crosses the shaft insertion hole 366 and communicates with the shaft insertion hole 366 at a central portion of the intermediate shaft 36.

Figure 4:
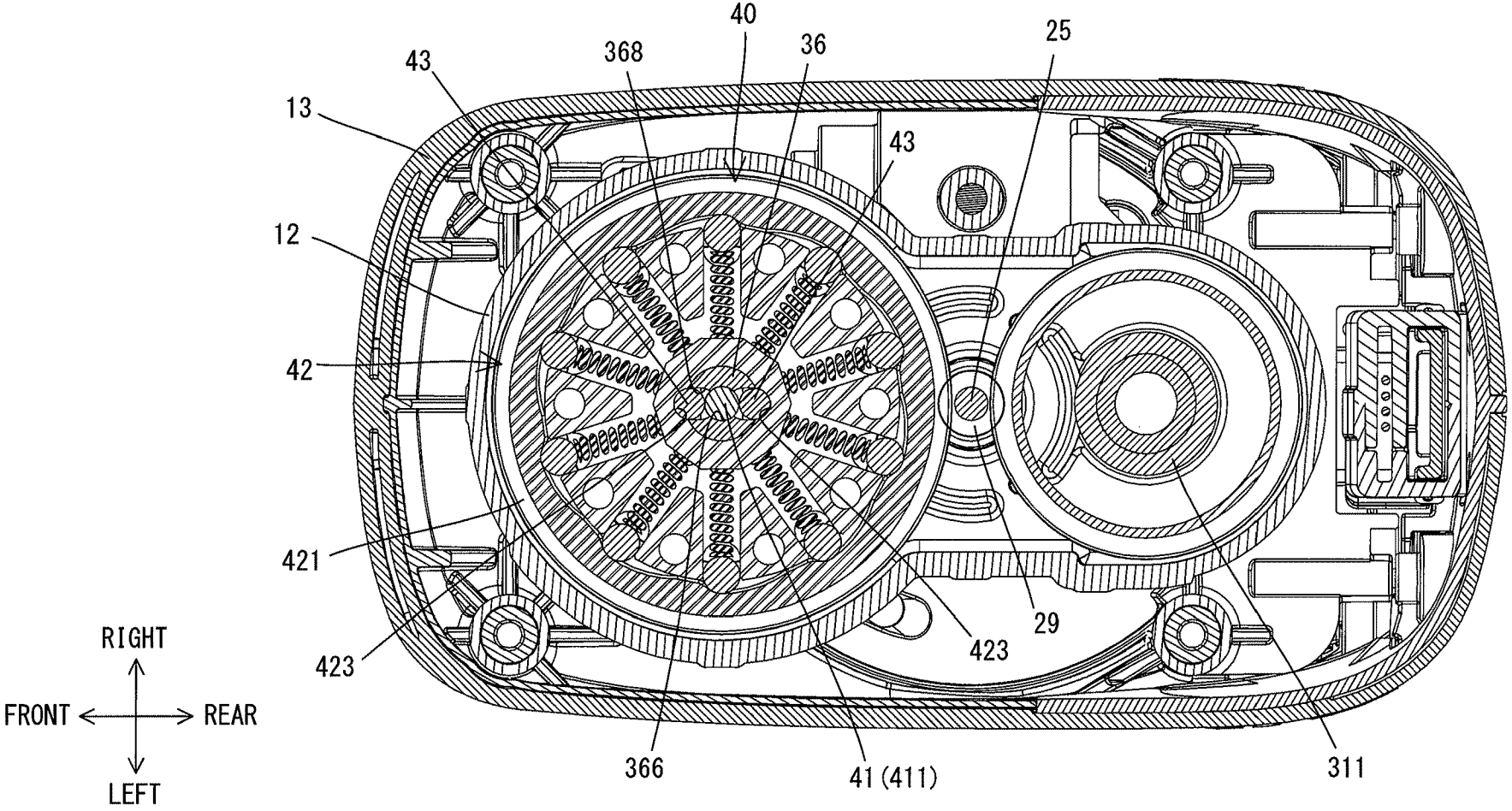
FIG. 4 is a sectional view taken along line IV-IV in FIG. 1.

As shown in FIGS. 3 and 4, the clutch mechanism 40 is mounted on the intermediate shaft 36 and configured to transmit torque or interrupt torque transmission from the motor shaft 25 to the intermediate shaft 36. The clutch mechanism 40 is configured to interrupt the torque transmission when excessive reaction torque acts on the body housing 11, which will be described in more detail later. In this embodiment, the clutch mechanism 40 includes an actuating shaft 41, a gear member 42 and two balls 43.

The actuating shaft 41 is formed as an elongate shaft. The actuating shaft 41 is inserted coaxially with the intermediate shaft 36 into the shaft insertion hole 366 of the intermediate shaft 36. A lower end portion of the actuating shaft 41 protrudes downward from a lower end of the shaft insertion hole 366 and further from a lower end portion of the gear hosing 12. The lower end portion of the actuating shaft 41 is connected to the solenoid 6 (see FIG. 5) via a link mechanism 7, which will be described later. The actuating shaft 41 includes a large-diameter part 411 having generally the same diameter as the inner diameter of the shaft insertion hole 366, and a small-diameter part 413 having a smaller diameter than the large-diameter part 411.

The gear member 42 is disposed coaxially with the intermediate shaft 36 and radially outward of the intermediate shaft 36 so as to be rotatable relative to the intermediate shaft 36. The gear member 42 has a driven gear 421 on its outer periphery which engages with the driving gear 29 of the motor shaft 25. The driven gear 421 is configured as a gear with a torque limiter. Further, a pair of ball holding grooves 423 are formed in a lower end portion of an inner periphery of the gear member 42. The ball holding grooves 423 are symmetrically disposed across the intermediate shaft 36 and recessed radially outward. The gear member 42 is disposed such that the ball holding grooves 423 communicate with the ball holding hole 368 of the intermediate shaft 36.

The two balls 43 are disposed between the actuating shaft 41 inserted in the shaft insertion hole 366 and the gear member 42 disposed around the intermediate shaft 36, in the radial direction of the intermediate shaft 36. The balls 43 are respectively disposed on opposite sides of the actuating shaft 41 in the ball holding hole 368. In this embodiment, the relation among the balls 43, the intermediate shaft 36 and the gear member 42 changes with a movement of the actuating shaft 41 in the up-down direction. As a result, the clutch mechanism 40 is switched between a transmittable state in which the clutch mechanism 40 is capable of transmitting torque and an interrupting state in which the clutch mechanism 40 is incapable of transmitting torque. Switching the state of the clutch mechanism 40 will be described in more detail later.

As shown in FIG. 2, the clutch mechanism 54 is mounted on the tool holder 30 and forms a part of a mode switching mechanism 5. The mode switching mechanism 5 is now described. The hammer drill 101 of this embodiment is configured to operate according to a selected one of two operation modes, that is, a hammer drill mode and a hammer mode. In the hammer drill mode, the drilling operation and the hammering operation are simultaneously performed. In the hammer mode, only the hammering operation is performed. The mode switching mechanism 5 is configured to switch, according to the selected operation mode, between a state in which torque transmission to the tool holder 30 is possible and a state in which the torque transmission to the tool holder 30 is impossible.

The mode switching mechanism 5 includes a mode switching dial 51, the clutch mechanism 54 and a clutch switching mechanism 52. The structure of the mode switching mechanism 5 itself is well known and is now only briefly described.

The mode switching dial 51 is rotatably connected to an upper end portion of the gear housing 12. The mode switching dial 51 is exposed to the outside through an opening formed in the outer housing 15 so as to allow a user's turning operation. The clutch mechanism 54 includes a gear sleeve 56 having a large bevel gear 561, and a clutch sleeve 55. The gear sleeve 56 is disposed radially outward of a rear end portion of the tool holder 30 so as to be rotatable around the driving axis A1. The large bevel gear 561 is provided on a rear end portion of the gear sleeve 56 and engaged with the small bevel gear 363 provided on the upper end portion of the intermediate shaft 36. The clutch sleeve 55 has a circular cylindrical shape, and spline-coupled to an outer periphery of the tool holder 30 (in other words, engaged with the tool holder 30 in a state in which the clutch sleeve 55 is prevented from moving in its circumferential direction and allowed to move in the front-rear direction) in front of the gear sleeve 56. The clutch sleeve 55 is connected to the mode switching dial 51 via the clutch switching mechanism 52 and configured to move in the front-rear direction within a prescribed moving range in interlock with the turning operation of the mode switching dial 51.

When the mode switching dial 51 is set at a position corresponding to the hammer drill mode, the clutch sleeve 55 is disposed in a rearmost position (shown in FIG. 2) within the moving range and engaged with a front end portion of the gear sleeve 56. Thus, the clutch mechanism 54 is in the transmittable state in which the clutch mechanism 54 is capable of transmitting the torque to the tool holder 30. Therefore, the position (rearmost position) of the clutch sleeve 55 engaged with the gear sleeve 56 is also referred to as a transmitting position. When the motor 2 is driven, the torque of the motor shaft 25 is transmitted to the tool holder 30 by the rotation transmitting mechanism 35, and the tool accessory 100 coupled to the tool holder 30 is rotationally driven around the driving axis A1. In the hammer drill mode, as described above, the motion converting mechanism 31 is also driven, so that the drilling operation and the hammering operation are simultaneously performed.

On the other hand, when the mode switching dial 51 is set at a position corresponding to the hammer mode, although not shown, the clutch sleeve 55 is moved forward away from the gear sleeve 56 and disposed in a frontmost position in which the clutch sleeve 55 cannot be engaged with the gear sleeve 56. In the frontmost position, the clutch sleeve 55 is engaged with a lock ring 301 which is integrally connected to the gear housing 12. The clutch mechanism 54 is thus turned to the interrupting state in which the clutch mechanism 54 is not capable of transmitting the torque to the tool holder 30. Therefore, in the hammer mode, only the hammering operation is performed when the motor 2 is driven.

A structure configured to actuate the clutch mechanism 40 is now described. In this embodiment, the clutch mechanism 40 may be actuated by the solenoid 6 via the link mechanism 7.

Figure 5:
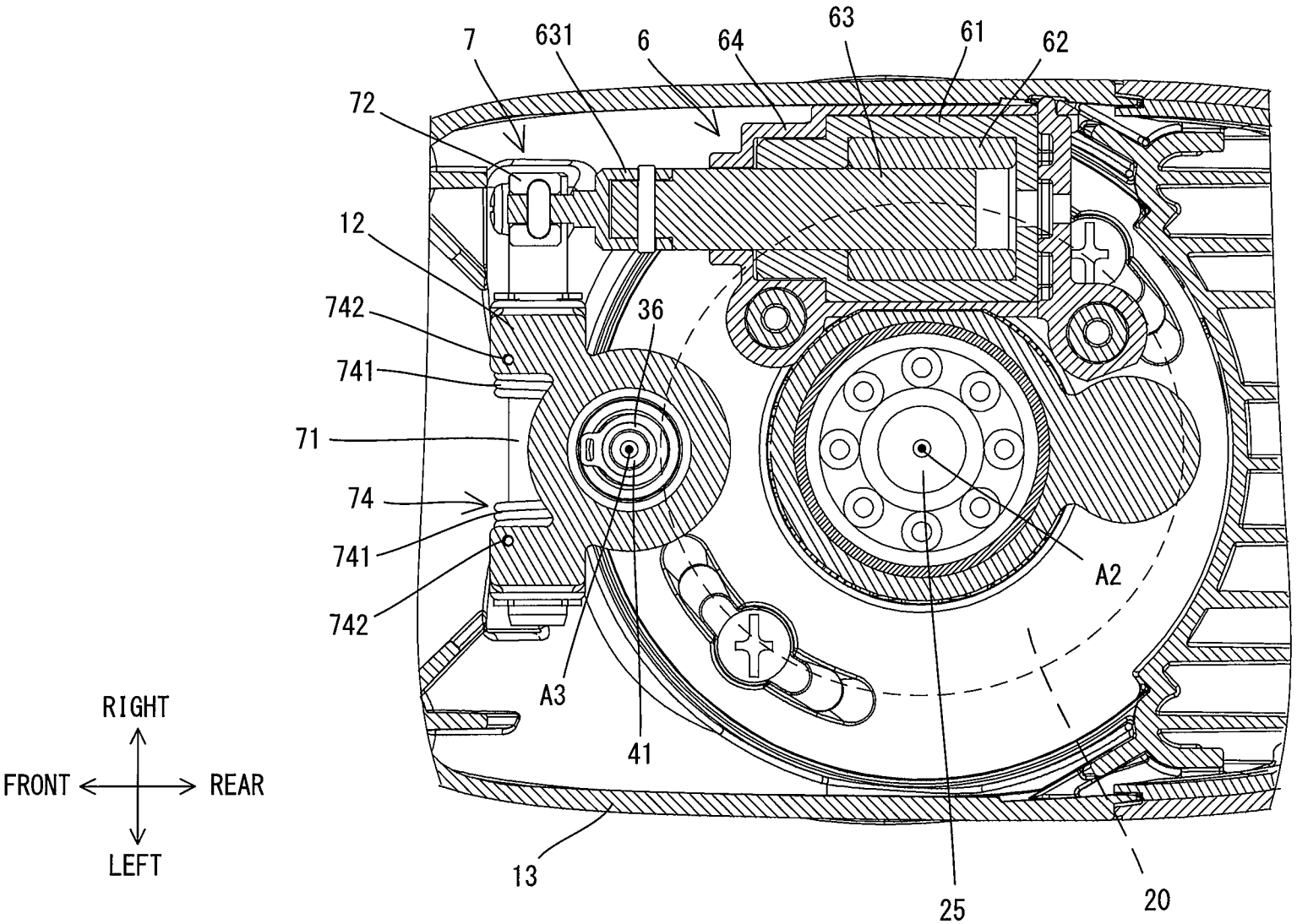
FIG. 5 is a sectional view taken along line V-V in FIG. 3.

The solenoid 6 is first explained. The solenoid 6 is a well-known electrical component which is configured to convert electrical energy into mechanical energy of linear motion by utilizing a magnetic field, which is generated by supplying a current to a coil. As shown in FIG. 5, in this embodiment, the solenoid 6 includes a cylindrical frame 61, a coil 62 housed within the frame 61, and a plunger 63 which is linearly movable within the coil 62.

Figure 6:
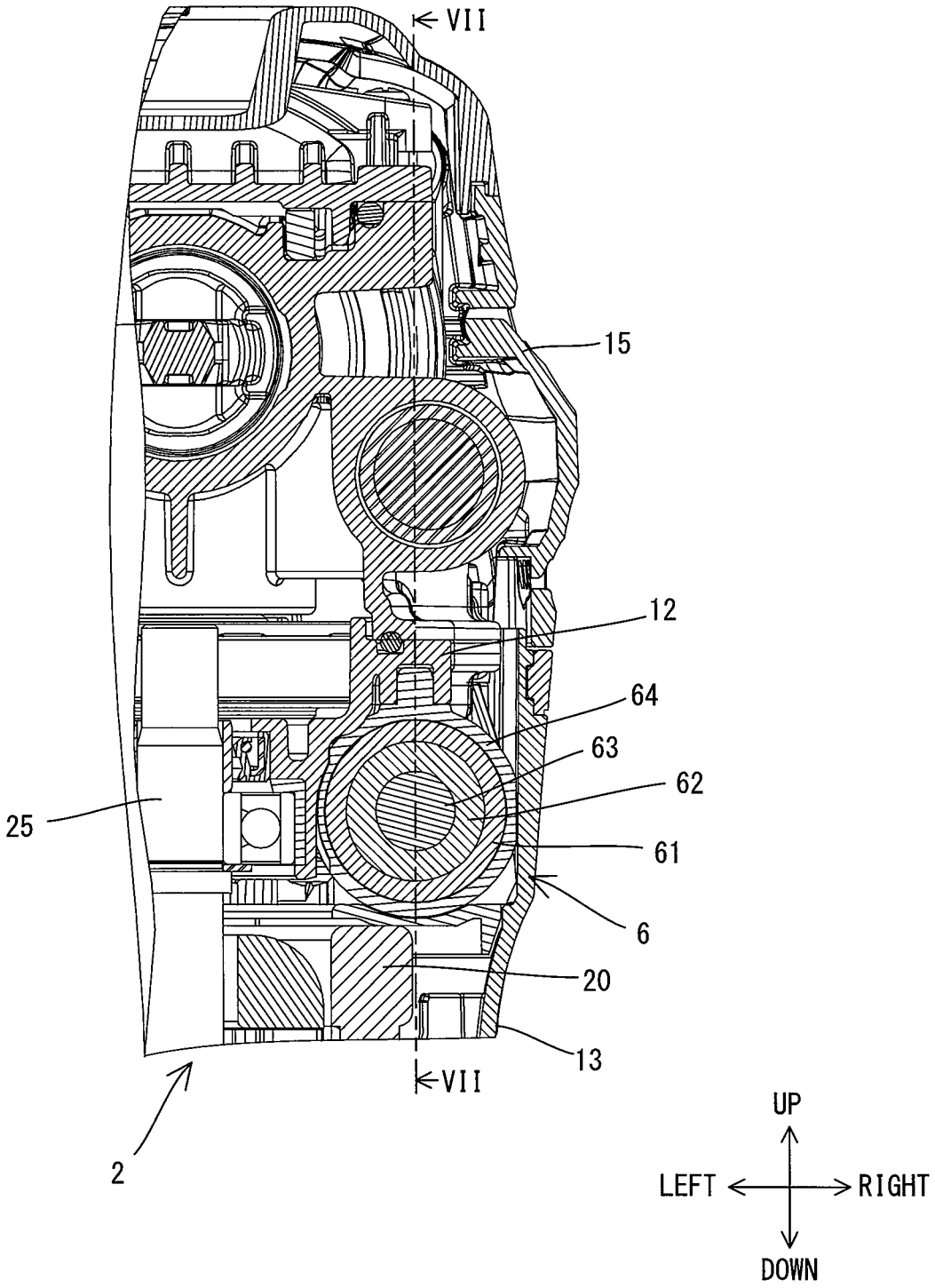
FIG. 6 is a sectional view taken along line VI-VI in FIG. 1.
Figure 7:
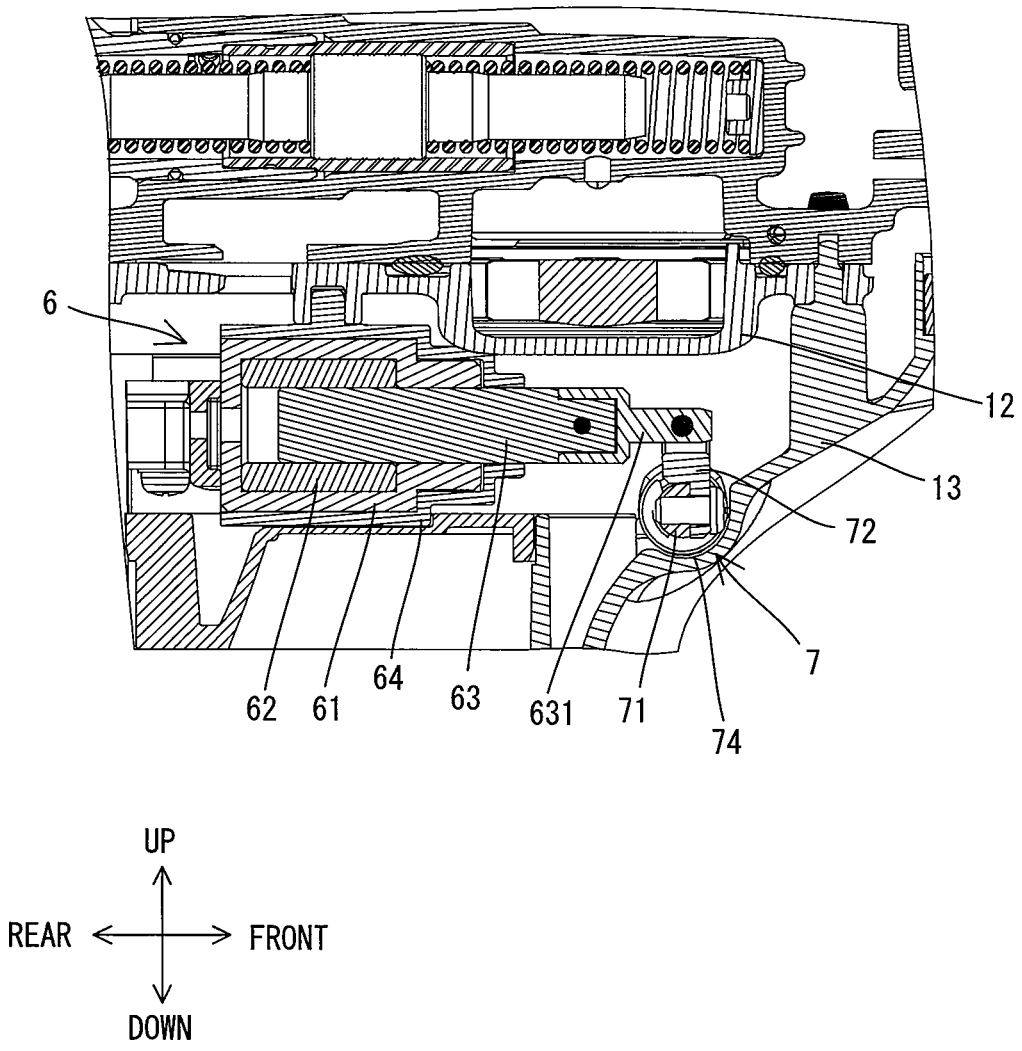
FIG. 7 is a sectional view taken along line VII-VII in FIG. 6.

As shown in FIGS. 6 and 7, the solenoid 6 is mounted on the underside of the gear housing 12. The solenoid 6 is mostly housed within a plastic case 64 and secured to the metal gear housing 12. In this embodiment, the motor 2 is disposed in a region below the gear housing 12 (that is, inside the motor housing 13). The motor shaft 25 has a far smaller diameter than the motor body 20. Thus, a space is formed around a portion of the motor shaft 25 which protrudes upward from the motor body 20. Therefore, in this embodiment, the solenoid 6 is disposed, utilizing this space.

More specifically, the solenoid 6 is mounted on the underside of a right lower end portion of the gear housing 12 such that an operating direction (moving direction) of the plunger 63 (in other words, an operation axis of the plunger 63 or a longitudinal axis of the solenoid 6) is parallel to the driving axis A1 (that is, the operating direction is the front-rear direction). A front end (protruding end) of the plunger 63 is arranged to face forward. As shown in FIG. 6, in the up-down direction, the solenoid 6 is disposed between the motor body 20 and the gear housing 12, within a range of the length of the motor shaft 25. As shown in FIG. 5, in the left-right direction, the solenoid 6 is disposed to the right of the intermediate shaft 36 and the motor shaft 25. Further, when viewed from above, the solenoid 6 is disposed to be partially overlapped with the motor body 20.

As shown in FIGS. 5 and 7, a cap 631 is fitted on a front end portion of the plunger 63. The cap 631 has a projection which protrudes forward. The plunger 63 is connected to the link mechanism 7 via the cap 631. As shown in FIGS. 3, 5, 7 and 8, the link mechanism 7 connects the plunger 63 and the actuating shaft 41 and is configured to move the actuating shaft 41 in interlock with a movement of the plunger 63. The link mechanism 7 includes a rotary shaft 71, a first arm part 72, a second arm part 73 and a torsion spring 74.

Figure 8:
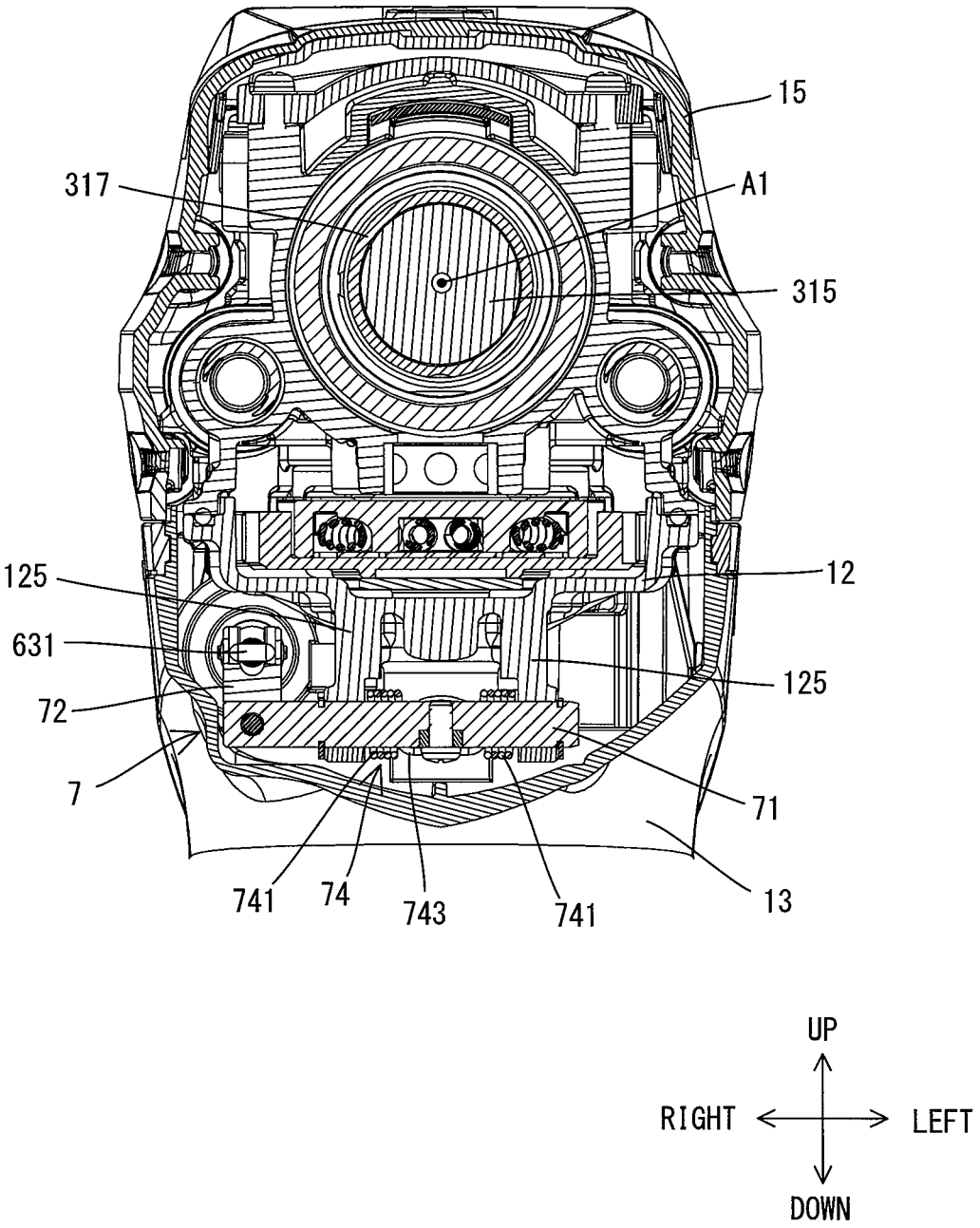
FIG. 8 is a sectional view taken along line VIII-VIII in FIG. 1.

As shown in FIGS. 7 and 8, the rotary shaft 71 is arranged to be rotatable around a rotation axis extending in the left-right direction, which is perpendicular to the operating direction of the plunger 63. More specifically, the rotary shaft 71 is rotatably supported by a pair of right and left arm parts 125 which protrude downward from a lower end of the gear housing 12. Further, the rotary shaft 71 is disposed below a front end portion of the cap 631.

The first arm part 72 protrudes generally perpendicularly to the rotary shaft 71 from a right end portion of the rotary shaft 71. The first arm part 72 is connected to the front end portion of the plunger 63 so as to be rotatable around a rotation axis extending in the left-right direction. When the solenoid 6 is not in operation, the first arm part 72 extends upward from the rotary shaft 71 and is connected to the front end portion of the cap 631.

As shown in FIG. 3, the second arm part 73 protrudes generally perpendicularly to the rotary shaft 71 and to the first arm part 72. The second arm part 73 is connected to the lower end portion of the actuating shaft 41 so as to be rotatable around a rotation axis extending in the left-right direction. When the solenoid 6 is not in operation, the second arm part 73 extends rearward from the rotary shaft 71 and is connected to the lower end portion of the actuating shaft 41.

As shown in FIGS. 5 and 8, the torsion spring 74 is configured as a double torsion spring having two coil parts 741. The coil parts 741 are fitted onto the rotary shaft 71 respectively on the right and left sides of the second arm part 73. Two arms 742 respectively extending from the two coil parts 741 are locked to the gear housing 12 (see FIG. 5). A connection part 743 connecting the two coil parts 741 is held in abutment with a lower end of the second arm part 73 (see FIGS. 3 and 8). With such a structure, the torsion spring 74 normally biases the rotary shaft 71 in a counterclockwise direction as viewed from the left side (counterclockwise in FIG. 3), that is, in a direction to turn the second arm part 73 upward.

As shown in FIG. 3, the actuating shaft 41 is biased upward by the biasing force of the torsion spring 74, and when the solenoid 6 is not in operation (that is, when the plunger 63 is placed in the frontmost position), the actuating shaft 41 is held in an uppermost position (an initial position) within the shaft insertion hole 366. At this time, as shown in FIGS. 3 and 4, the large-diameter part 411 of the actuating shaft 41 is placed in the central portion of the ball holding hole 368 of the intermediate shaft 36. The large-diameter part 411 faces the balls 43 and prevents the balls 43 from moving radially inward from the ball holding hole 368. Each of the balls 43 is not completely received within the ball holding hole 368, but disposed between the large-diameter part 411 and the gear member 42 over the ball holding hole 368 and the ball holding groove 423 of the gear member 42.

With such a structure, when the gear member 42 rotates, the intermediate shaft 36 rotates in a state in which the intermediate shaft 36 is combined (integrated) with the gear member 42 via the balls 43. Thus, torque can be transmitted from the motor shaft 25 to the intermediate shaft 36. Therefore, the position of the actuating shaft 41 in which the large-diameter part 411 faces the balls 43 is hereinafter also referred to as a transmitting position.

Figure 9:
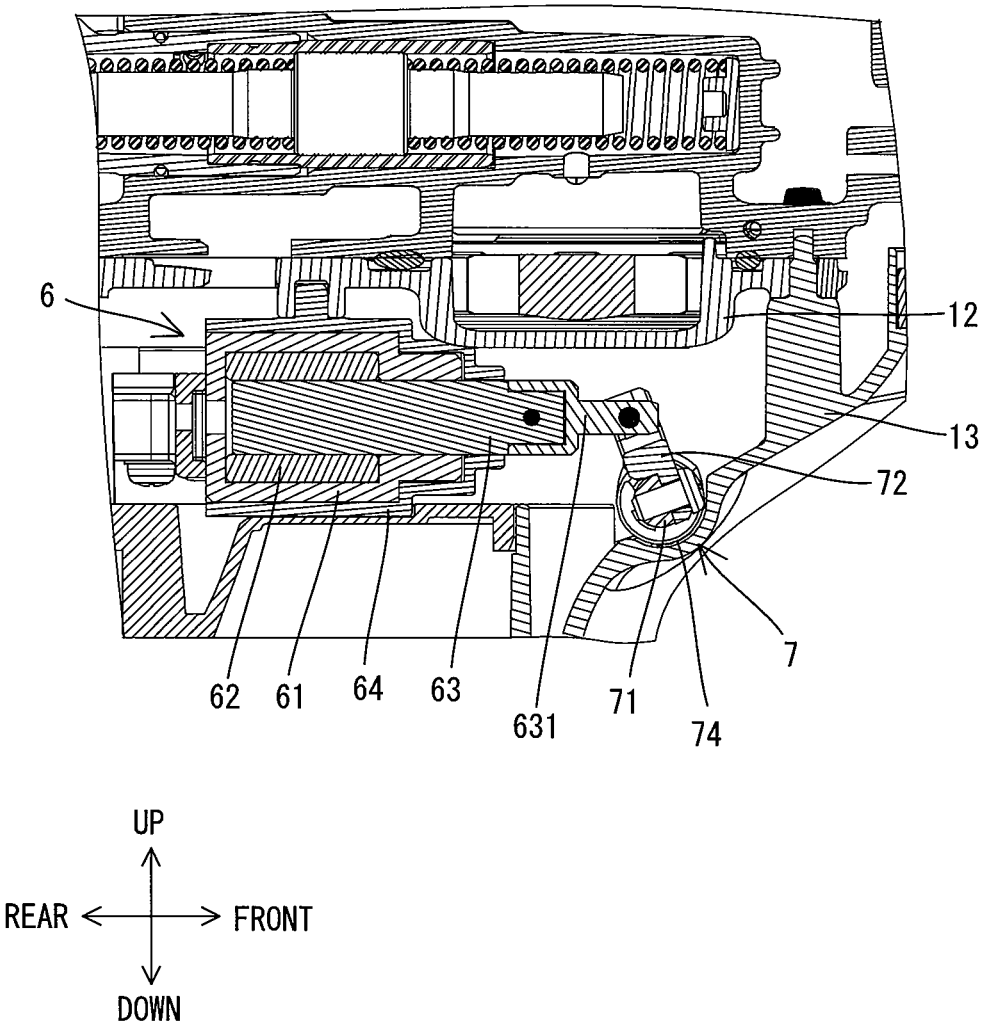
FIG. 9 is a sectional view, corresponding to FIG. 7, for illustrating operations of a solenoid and a link mechanism.
Figure 10:
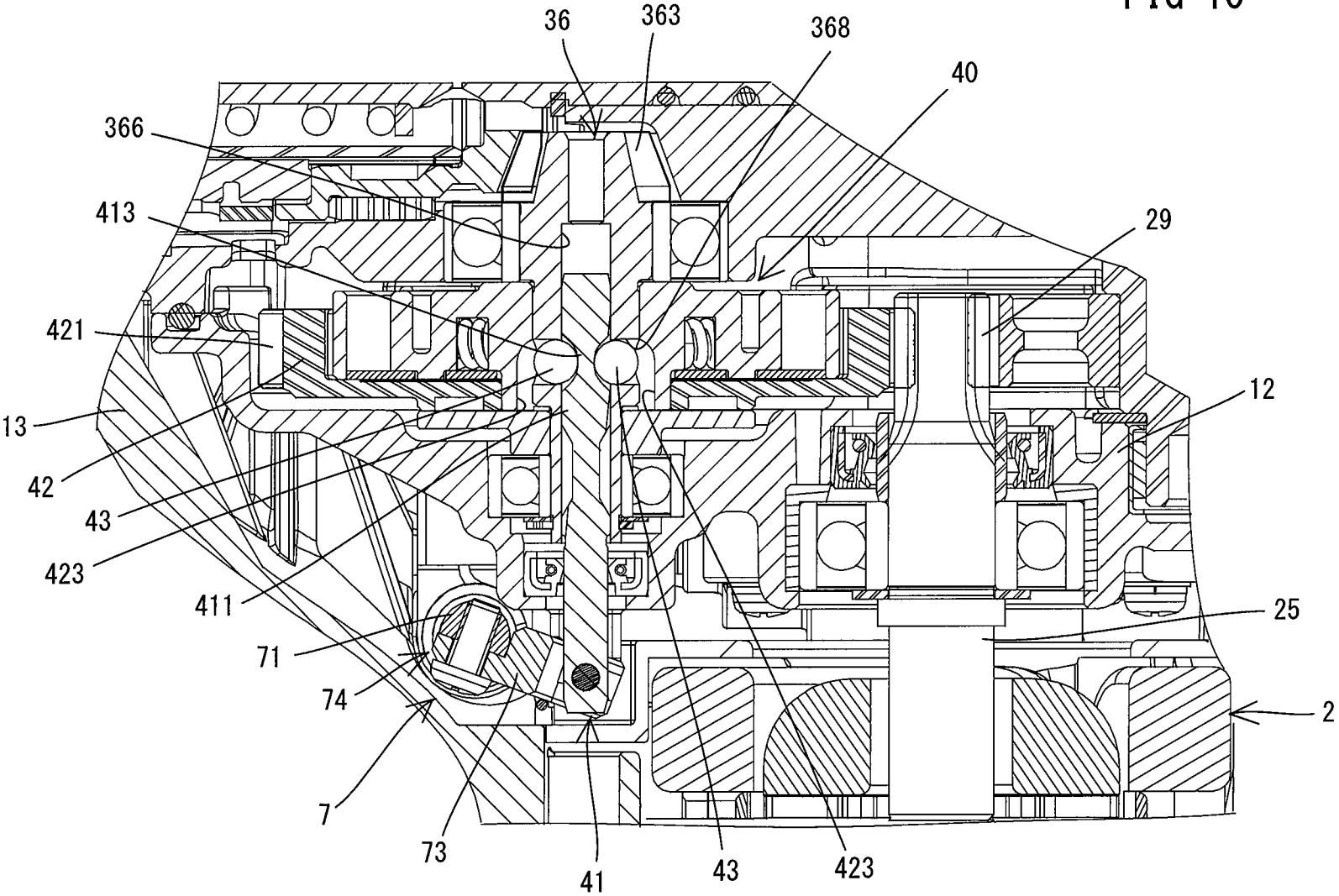
FIG. 10 is a sectional view, corresponding to FIG. 3, for illustrating operations of the link mechanism and a clutch mechanism.
Figure 11:
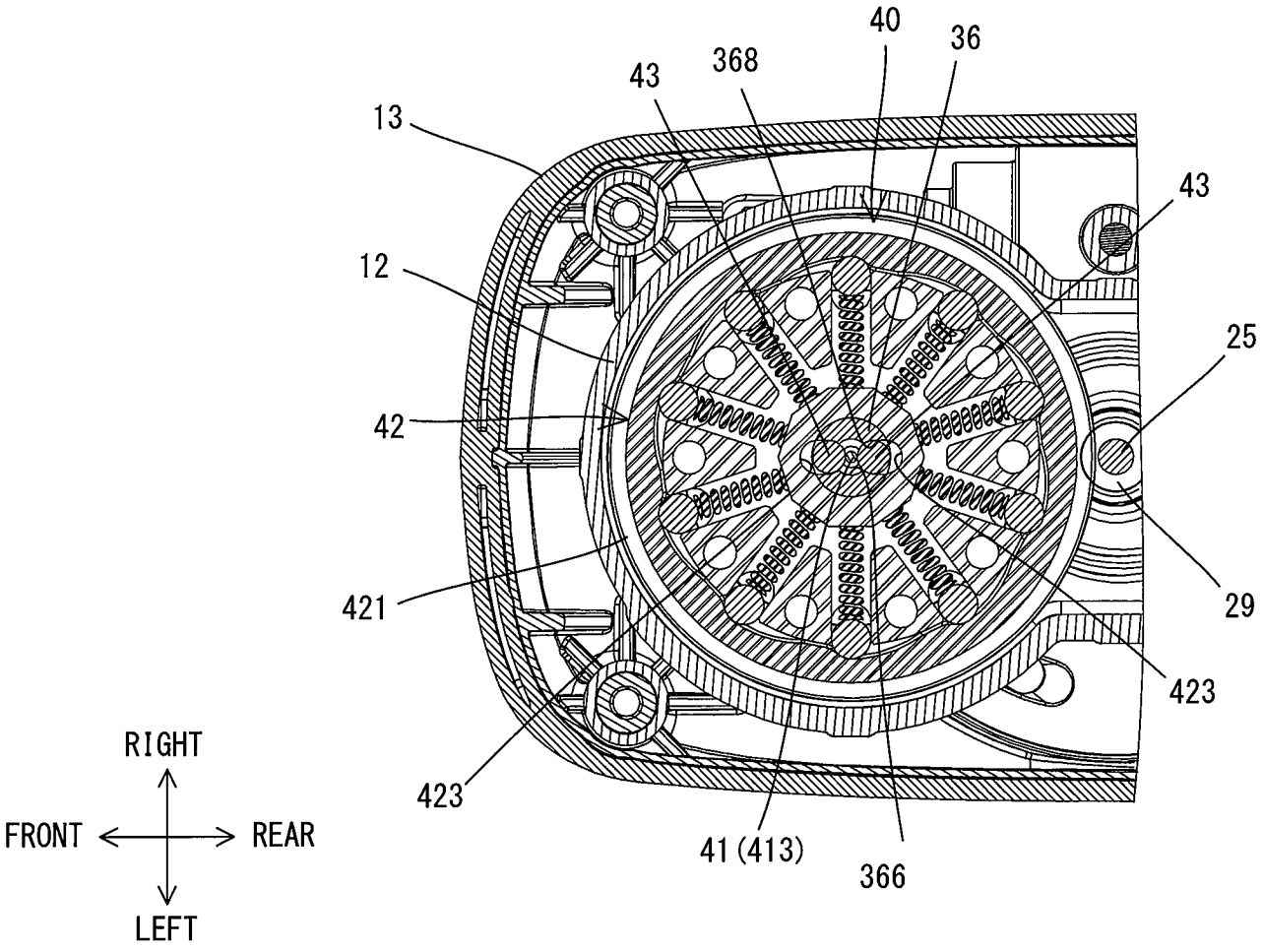
FIG. 11 is a sectional view, corresponding to FIG. 4, for illustrating an operation of the clutch mechanism.

The solenoid 6 of this embodiment is of a so-called pull-type. When a current passes through the coil 62, as shown in FIG. 9, the plunger 63 is retracted into the frame 61 and pulls the first arm part 72 rearward. Thus, the rotary shaft 71 is rotated counterclockwise as viewed from the right side (counterclockwise in FIG. 9), against the biasing force of the torsion spring 74. As shown in FIG. 10, as the rotary shaft 71 is rotated, the second arm part 73 pulls down the actuating shaft 41 from the initial position (transmitting position) to a lowermost position (shown in FIG. 10). As a result, as shown in FIGS. 10 and 11, the small-diameter part 413 of the actuating shaft 41 is placed in the central portion of the ball holding hole 368. In other words, the small-diameter part 413 faces the balls 43. Each of the balls 43 is loosely disposed between the small-diameter part 413 and the gear member 42 within the ball holding hole 368 and the ball holding groove 423. The small-diameter part 413 allows the balls 43 to move radially inward from the ball holding hole 368. It is noted that the balls 43 have a diameter which is generally equal to a distance in the radial direction from the outer periphery of the small-diameter part 413 to the outer periphery of the intermediate shaft 36.

With such a structure, when the gear member 42 rotates, the balls 43 are placed within the ball holding hole 368, and the gear member 42 independently rotates, without being combined with the intermediate shaft 36 via the balls 43. Thus, the torque transmission from the motor shaft 25 to the intermediate shaft 36 is interrupted. Therefore, the position of the actuating shaft 41 in which the small-diameter part 413 faces the balls 43 is hereinafter also referred to as an interrupting position. Further, in this embodiment, when such a state occurs that excessive reaction torque acts on the body housing 11 (such a state is also referred to as a kickback state or spinning state), the controller 9 actuates the solenoid 6 and thereby actuates the clutch mechanism 40 so as to interrupt the torque transmission, which will be described in more detail later.

Now, the handle 17 and its internal configuration are described.

As shown in FIG. 1, a switch lever 171 is provided on the front side of the grip part 170. The switch lever 171 is configured to be depressed by a user. Further, a switch 172 is disposed within the handle 17. The switch 172 is configured to be normally held in an off state, and to be turned on when the switch lever 171 is depressed.

Elastic members 175 and 176 are disposed between the upper connection part 173 of the handle 17 and a rear upper end portion of the gear housing 12, and between the lower connection part 174 and a rear lower end portion of the motor housing 13, respectively. In this embodiment, a compression coil spring is employed as each of the elastic members 175, 176. The handle 17 is connected to the body housing 11 via the elastic members 175, 176 so as to be movable relative to the body housing 11 in the extending direction of the driving axis A1 (the front-rear direction). Further, the outer housing 15 which covers the gear housing 12 is fixedly connected to the handle 17 and can move integrally with the handle 17 relative to the body housing 11. With such a structure, transmission of vibration (particularly, vibration in the driving axis A1 direction generated by the hammering operation) from the body housing 11 to the handle 17 and the outer housing 15 can be reduced.

Now, operations of the hammer drill 101 (particularly, the interruption of the torque transmission in the kickback state) in the hammer drill mode is explained.

As described above, when the switch lever 171 is depressed and the switch 172 is turned on, the control circuit 91 (CPU) of the controller 9 energizes the motor 2 and starts driving of the motor 2. In the hammer drill mode, as described above, the clutch mechanism 54 of the mode switching mechanism 5 is held in the state (transmittable state) in which the clutch sleeve 55 and the gear sleeve 56 are engaged with each other. Therefore, when the motor 2 is driven, the hammering operation and the drilling operation are performed.

The control circuit 91 determines whether the kickback state has occurred or not, based on the acceleration detected by the acceleration sensor 93 (a signal from the acceleration sensor 93), while the motor 2 is driven. The acceleration is an example of an indicator which indicates the motion state (more specifically, rotation around the driving axis A1) of the body housing 11. Any method may be used to determine the kickback state. For example, a method may be employed in which, when the detected acceleration or a value (such as an angular acceleration) calculated based on the detected acceleration exceeds a prescribed threshold, it is determined that the kickback state has occurred.

When the control circuit 91 determines that the kickback state has occurred, the control circuit 91 energizes the coil 62 of the solenoid 6 so as to actuate the solenoid 6. Then, as described above, the plunger 63 is retracted rearward, and the actuating shaft 41 is moved downward to the interrupting position via the link mechanism 7, so that the clutch mechanism 40 is actuated (see FIGS. 9 to 11). As a result, the torque transmission from the motor shaft 25 to the intermediate shaft 36 is interrupted, and the tool holder 30 stops rotating.

Thereafter, when the switch lever 171 is released and the switch 172 is turned off, the control circuit 91 stops driving of the motor 2 and energization to the solenoid 6. Thus, the plunger 63 returns to the frontmost position, and the rotary shaft 71 is rotated counterclockwise as viewed from the left side by the biasing force of the torsion spring 74. The actuating shaft 41 is pushed up to the initial position (transmitting position) by the second arm part 73, and the clutch mechanism 40 is returned to the transmittable state (see FIGS. 7, 3 and 4).

As described above, in this embodiment, the clutch mechanism 40 is provided on the torque transmission path from the motor 2 to the tool holder 30 (the final output shaft). Further, the clutch mechanism 40 is mechanically actuated via the plunger 63 of the solenoid 6 which linearly moves. The solenoid 6 is a cheaper electrical component than an electromagnetic clutch. Further, although the clutch mechanism 40 itself is provided on the torque transmission path, the arrangement position of the solenoid 6 can be freely selected as long as the solenoid 6 is capable of actuating the clutch mechanism 40. Therefore, according to this embodiment, a more rational structure which is capable of interrupting torque transmission when excessive reaction torque acts on the body housing 11 can be realized, compared to a case in which an electromagnetic clutch is employed. In this embodiment, the clutch mechanism 40 is provided on the intermediate shaft 36 which rotates at lower speed than the motor shaft 25. Therefore, the torque transmission to the intermediate shaft 36 can be properly interrupted even with the mechanical clutch mechanism 40 of which interrupting speed is not as high as that of an electromagnetic clutch.

Further, in this embodiment, the motion of the plunger 63 of the solenoid 6 in the front-rear direction is converted by the link mechanism 7 into motion of the actuating shaft 41 of the clutch mechanism 40 in the up-down direction. Therefore, it is not necessary to arrange the solenoid 6 and the clutch mechanism 40 side by side in the front-rear direction, so that a size increase (an increase in the length in the front-rear direction) of the whole device can be suppressed. Further, the operating direction of the plunger 63 can be easily made different from the moving direction of the actuating shaft 41 by using the torsion spring 74 in the link mechanism 7.

Further, the link mechanism 7 converts the motion of the plunger 63 in the front-rear direction into rotating motion of the rotary shaft 71 and further converts the rotating motion into the motion of the actuating shaft 41 in the up-down direction. In other words, the link mechanism 7 performs direction conversion twice. In such a structure in which the link mechanism 7 performs conversion of moving directions more than once, flexibility (degree of freedom) in setting the operating direction of the plunger 63 and the moving direction of the actuating shaft 41 can be increased, so that flexibility concerning the arrangement position of the solenoid 6 can be further increased. Therefore, in this embodiment, the solenoid 6 is disposed in a space around the motor shaft 25 between the lower end of the gear housing 12 and the motor body 20 so that a region which tends to become a dead space is effectively utilized. Further, the solenoid 6 which is mostly housed within the plastic case 64 can be protected from transmission of heat from the gear housing 12 and entry of dust.

Further, in this embodiment, the clutch mechanism 40 includes the actuating shaft 41 inserted into the intermediate shaft 36, the gear member 42 arranged coaxially with and radially outward of the intermediate shaft 36, and the balls 43 disposed between the actuating shaft 41 and the gear member 42. When the solenoid 6 is not in operation, the large-diameter part 411 of the actuating shaft 41 faces the balls 43, and the intermediate shaft 36 and the gear member 42 integrally rotate in a state in which the intermediate shaft 36 and the gear member 42 are combined via the balls 43, so that the torque is transmitted. On the other hand, when the solenoid 6 is operated, the actuating shaft 41 is moved downward along the rotation axis A3 of the intermediate shaft 36 so that the small-diameter part 413 faces the balls 43, thereby allowing the balls 43 to move radially inward and allowing the gear member 42 to rotate relative to the intermediate shaft 36. Thus, the rotation of the gear member 42 can not be transmitted to the intermediate shaft 36, so that torque transmission is interrupted. In this manner, the torque transmission to the intermediate shaft 36 can be interrupted simply by actuating the solenoid 6 to linearly move the actuating shaft 41 disposed within the intermediate shaft 36. Further, a size increase of the clutch mechanism 40 in the axial direction of the intermediate shaft 36 can be suppressed by using the two clutch members (the actuating shaft 41 and the gear member 42) respectively disposed inside and outside the intermediate shaft 36.

Further, in this embodiment, when the solenoid 6 is not in operation, the link mechanism 7 is held in the initial position by the biasing force of the torsion spring 74, so that the actuating shaft 41 is disposed in the transmitting position. When the solenoid 6 is in operation, the link mechanism 7 is rotated from the initial position against the biasing force of the torsion spring 74, so that the actuating shaft 41 is moved to the interrupting position. Thus, with such a simple structure using the torsion spring 74, the actuating shaft 41 can be held in the transmitting position when the solenoid 6 is not in operation, while the actuating shaft 41 is moved to the interrupting position when the solenoid 6 is in operation. Furthermore, when the solenoid 6 is turned from the operating state to the non-operating state, the actuating shaft 41 can be returned to the transmitting position by the biasing force of the torsion spring 74.

Second Embodiment

A second embodiment is now explained with reference to FIGS. 12 to 17. In this embodiment, a hammer drill 102 is described as an example. In the hammer drill 102 of this embodiment, the clutch mechanism 40 is not provided on the intermediate shaft 36. In place of the clutch mechanism 40, the clutch mechanism 54 provided on the tool holder 30 is actuated to interrupt torque transmission to the tool holder 30 upon occurrence of a kickback state. Most of the structures of the hammer drill 102 are common to those of the hammer drill 101 of the first embodiment. Therefore, the common structures or components are given the same numerals as in the first embodiment, and are appropriately omitted or simplified in the drawings and the following description, and structures that are different from the first embodiment are now mainly described.

Figure 12:
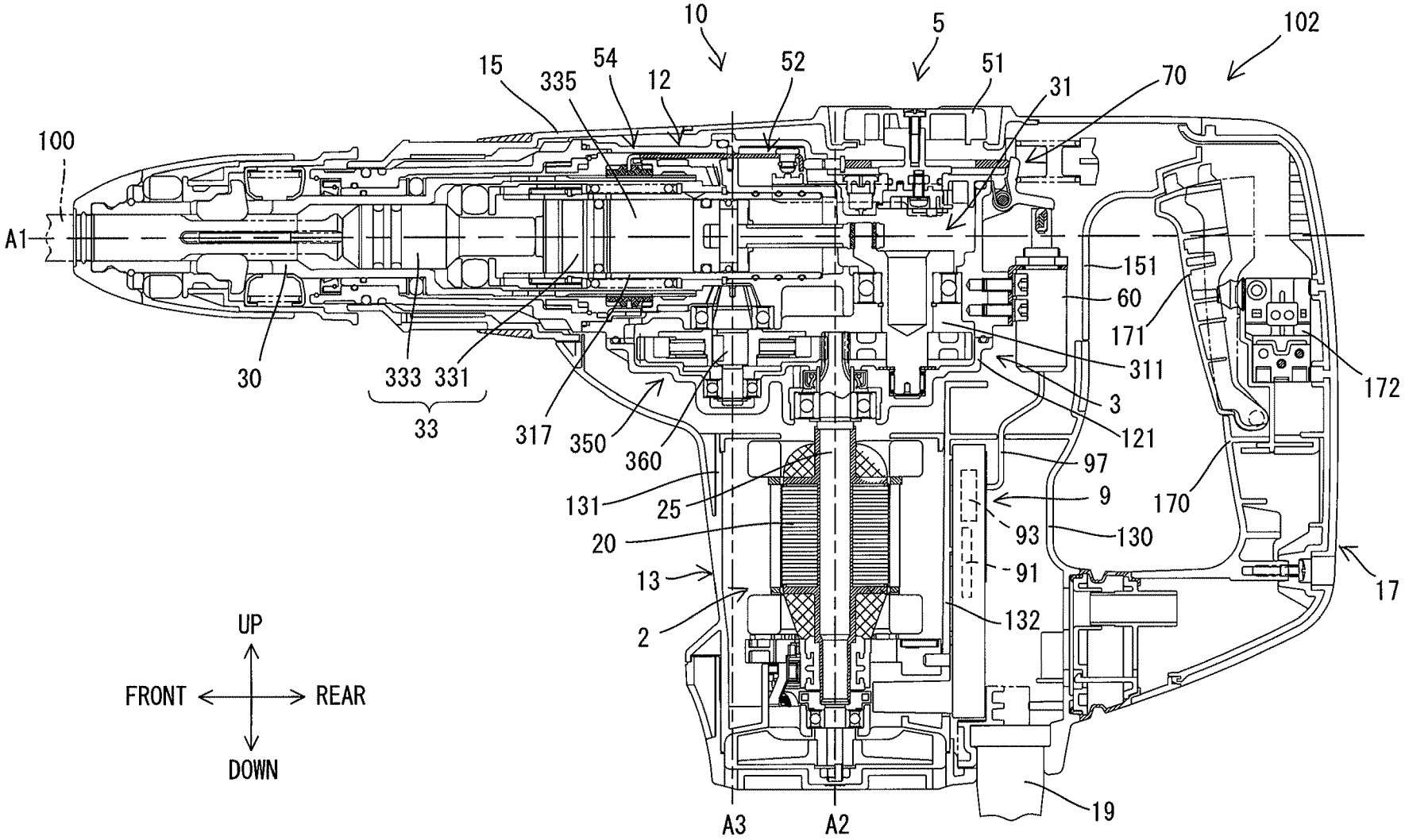
FIG. 12 is a longitudinal section of a hammer drill according to a second embodiment.

As shown in FIG. 12, the hammer drill 102 includes a body 10 and a handle 17 which have generally the same structures as those of the hammer drill 101 of the first embodiment. In this embodiment, the driving mechanism 3 housed in the gear housing 12 includes a motion converting mechanism 31 and a striking mechanism 33 which are identical to those of the first embodiment, and a rotation transmitting mechanism 350 which is different from the rotation transmitting mechanism 35 of the first embodiment.

Figure 13:
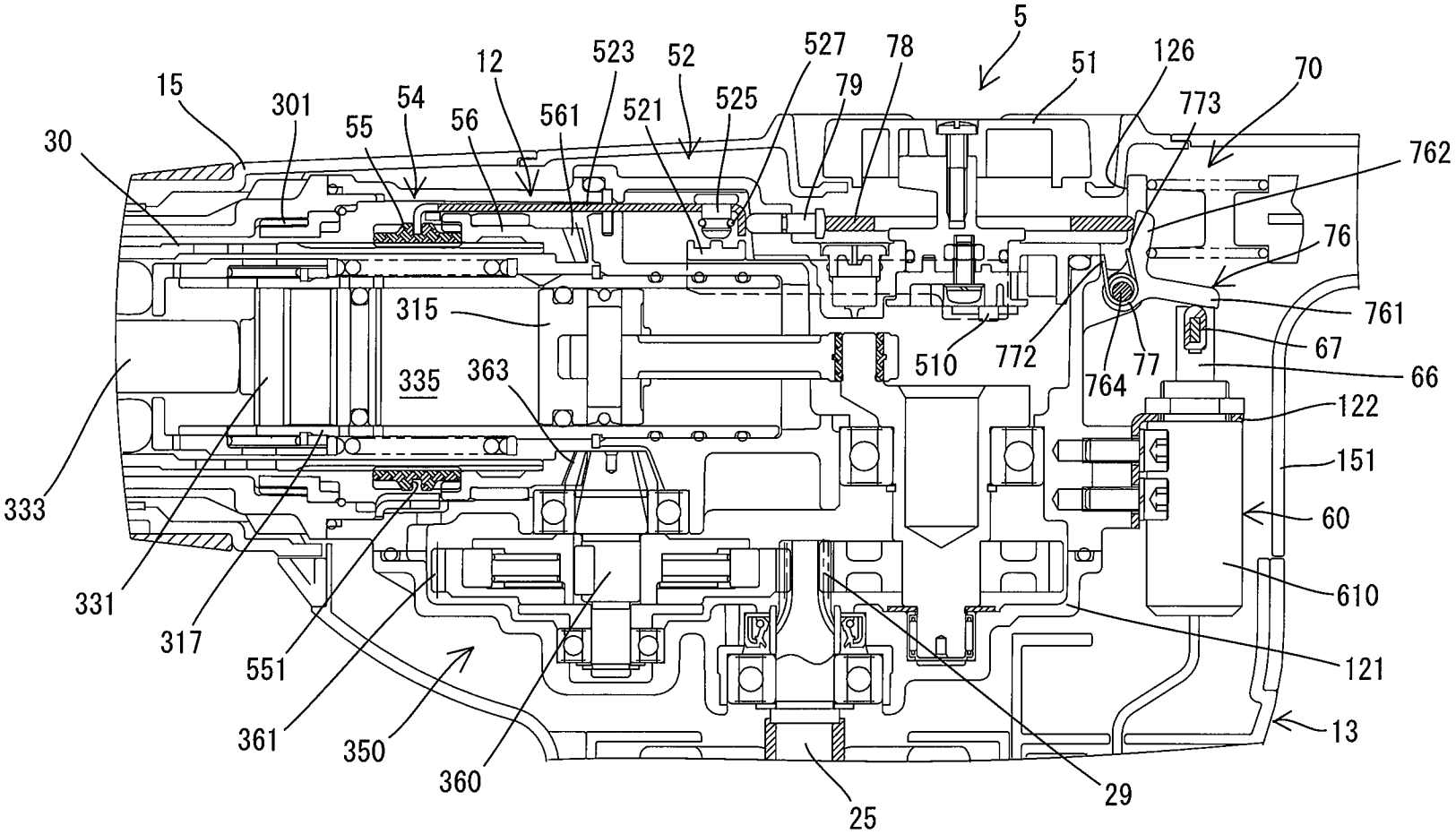
FIG. 13 is a partial enlarged view of FIG. 12.

The rotation transmitting mechanism 350 is now described. As shown in FIG. 13, the rotation transmitting mechanism 350 of this embodiment includes a driving gear 29, a driven gear 361, an intermediate shaft 360, a small bevel gear 363 and a clutch mechanism 54. Like in the first embodiment, the rotation transmitting mechanism 350 is configured as a speed-reducing gear mechanism, and the rotation speeds of the motor shaft 25, the intermediate shaft 360 and the tool holder 30 are reduced in this order.

The driven gear 361 is provided on the intermediate shaft 360 and engaged with the driving gear 29 of the motor shaft 25. The driven gear 361 is configured as a gear with a torque limiter. Like the intermediate shaft 36 of the first embodiment, the intermediate shaft 360 is arranged in parallel to the motor shaft 25 and forward of the motor shaft 25. Unlike the intermediate shaft 36, the intermediate shaft 360 is not provided with a clutch mechanism which is configured to be actuated upon occurrence of a kickback state.

In this embodiment, the clutch mechanism 54 which is configured to be actuated upon occurrence of a kickback state is mounted on the tool holder 30. The clutch mechanism 54 is configured to transmit torque from the intermediate shaft 360 to the tool holder 30 or interrupt the torque transmission. As described in the first embodiment, the clutch mechanism 54 is provided as a part of the mode switching mechanism 5.

Figure 14:
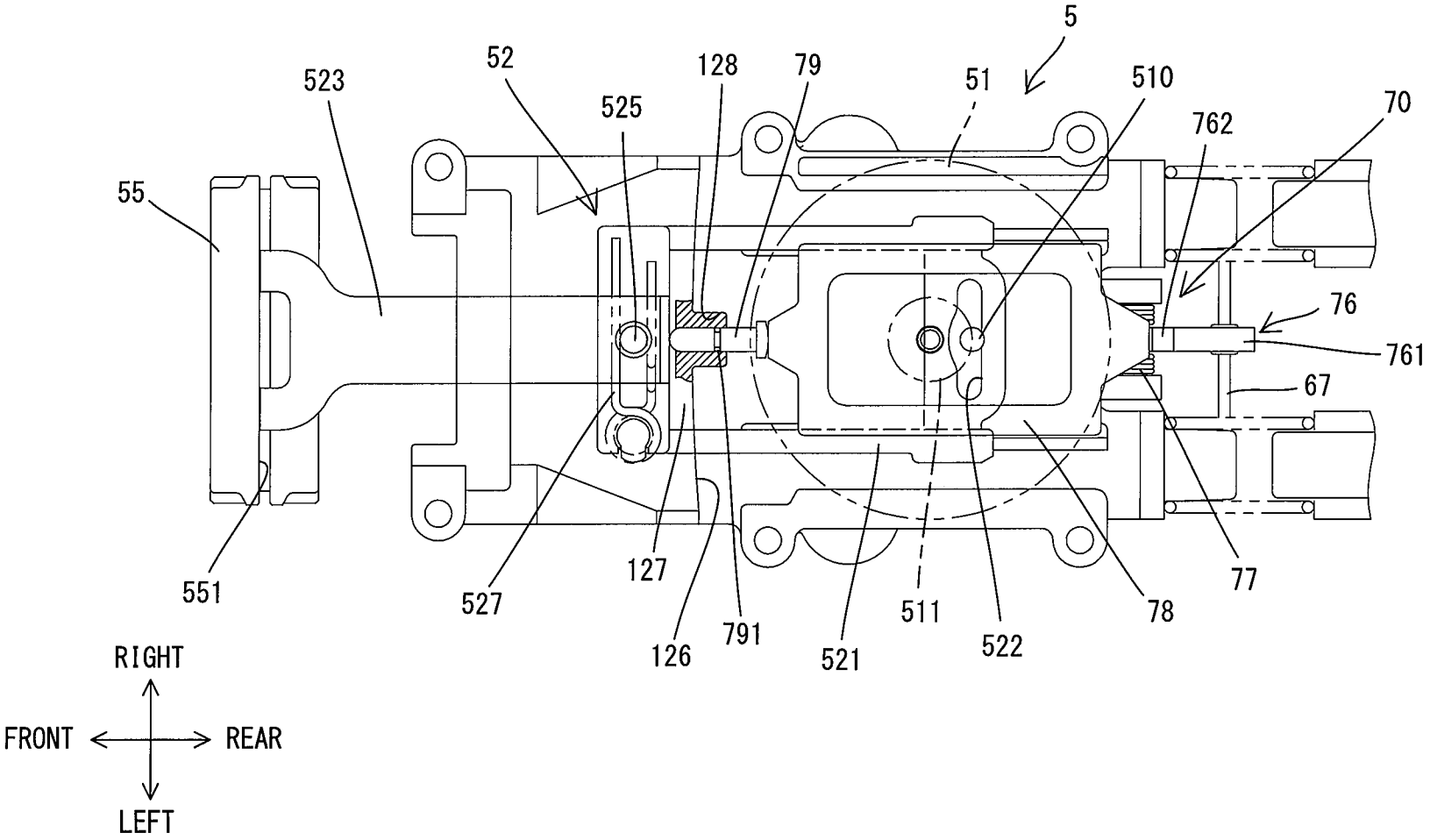
FIG. 14 is a view for illustrating a link mechanism and a mode switching mechanism as viewed from above.

The structure of the clutch switching mechanism 52 of the mode switching mechanism 5, which has been only briefly described in the first embodiment, is now described in detail. As shown in FIGS. 13 and 14, the clutch switching mechanism 52 includes a slide member 521, an engagement arm 523, a connection pin 525 and a torsion spring 527.

The slide member 521 has a rectangular frame-like shape and is disposed to be slidable in the front-rear direction within a recess 126 which is formed in an upper end portion of the gear housing 12. An elongate hole 522 is formed in a rear end portion of the slide member 521. An eccentric pin 510 protruding downward from a lower end of the mode switching dial 51 is inserted through the elongate hole 522. The eccentric pin 510 is provided at a position displaced from the center of rotation of the mode switching dial 51, and revolves along a path 511 along with the turning operation of the mode switching dial 51. The slide member 521 is slid in the front-rear direction within a prescribed moving range by a front-rear direction component of revolving motion of the eccentric pin 510.

The engagement arm 523 is an elongate plate-like member arranged to extend in the front-rear direction. The engagement arm 523 has bifurcated front end portions. Each of the front end portions is bent downward like a hook and engaged with an annular groove 551 formed in an outer periphery of the clutch sleeve 55. The connection pin 525 is inserted through a through hole which extends through a rear end portion of the engagement arm 523 in the up-down direction. The torsion spring 527 is held on a left front end portion of the slide member 521. The torsion spring 527 is disposed such that an axis of its coil portion extends in the up-down direction and two arms cross each other and extend to the right from the coil portion. A lower end portion of the connection pin 525 is pinched between the two arms of the torsion spring 527 by the biasing force of the torsion spring 527. One of the arms which is disposed on the rear side of the connection pin 525 is locked to the slide member 521.

With the above-described structure, when the mode switching dial 51 is set at a position (shown in FIG. 14) corresponding to the hammer drill mode, the slide member 521 is placed in a rearmost position within the moving range. Thus, the engagement arm 523 connected to the slide member 521 via the connection pin 525 and the torsion spring 527 is also placed in a rearmost position. As shown in FIG. 13, the clutch sleeve 55 engaged with the engagement arm 523 is also placed in a rearmost position and engaged with a front end portion of the gear sleeve 56. Thus, the clutch mechanism 54 is placed in the transmittable state. On the other hand, when the mode switching dial 51 is set at a position corresponding to the hammer mode, the slide member 521, the engagement arm 523 and the clutch sleeve 55 are placed in their respective frontmost positions. Thus, the clutch mechanism 54 is placed in the interrupting state.

The hammer drill 102 of this embodiment is configured to actuate the clutch mechanism 54 without using the clutch switching mechanism 52 in order to interrupt torque transmission from the intermediate shaft 360 to the tool holder 30 when a kickback state occurs in the hammer drill mode (in other words, when the clutch mechanism 54 is in the transmittable state). More specifically, two solenoids 60 are configured to actuate the clutch mechanism 54 via a link mechanism 70 upon occurrence of a kickback state.

Figure 15:
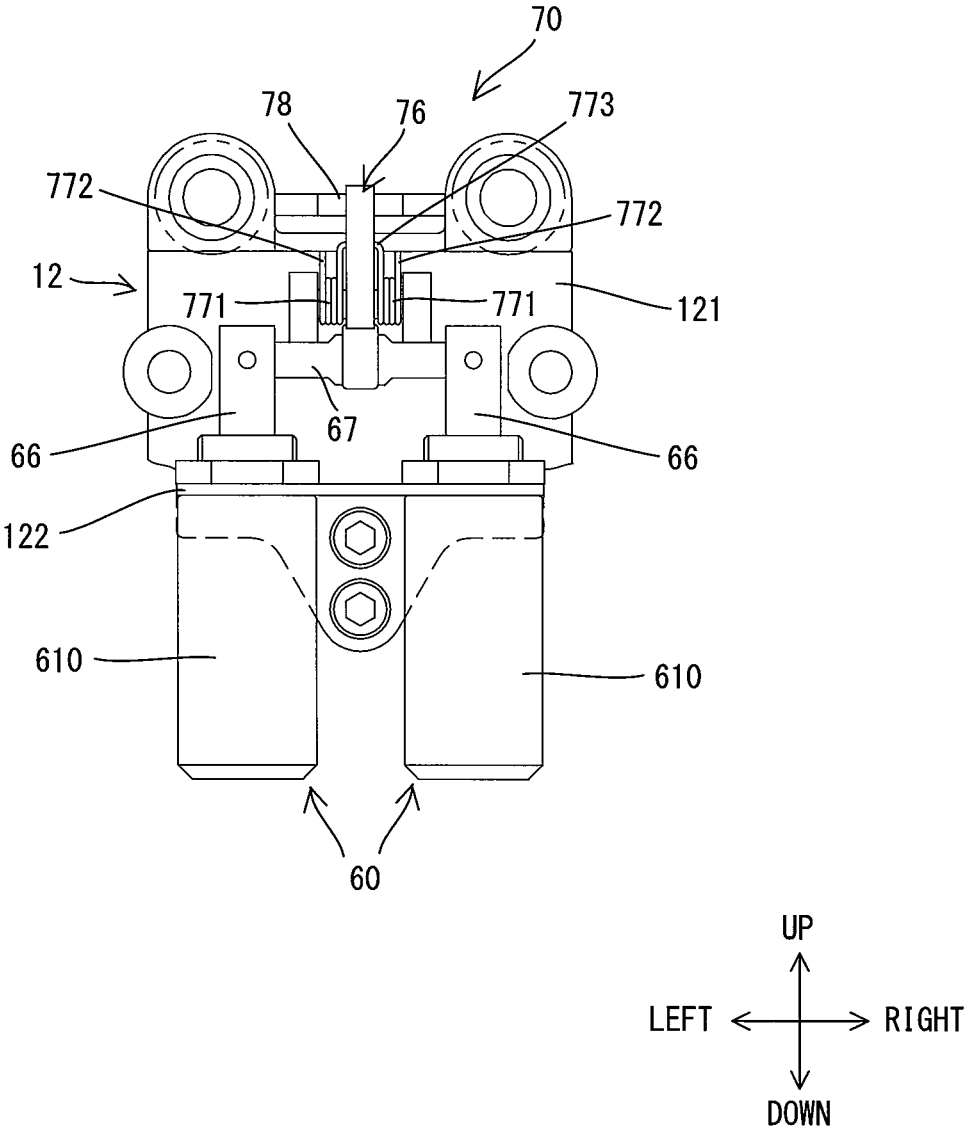
FIG. 15 is a view for illustrating a solenoid and the link mechanism as viewed from the rear.

As shown in FIGS. 12 and 15, the two solenoids 60 are disposed rearward of the gear housing 12. More specifically, a support plate 122, which is generally L-shaped in a side view, is fastened with screws to a rear wall 121 of the gear housing 12 behind the crank shaft 311. The solenoids 60 are arranged side by side in the left-right direction and supported by the support plate 122. Thus, the solenoids 60 are disposed in a space between the gear housing (the rear wall 121) and a rear wall 151 of the outer housing 15. Therefore, it can be said that the solenoids 60 are disposed in a region above and relatively close to the controller 9 which is disposed behind the motor body 20 within the motor housing 13 (specifically, between the inner wall 131 (the rear wall 132) and the peripheral wall 130 of the motor housing 13). The solenoids 60 are electrically connected to the controller 9 by a wiring 97. In this embodiment, from the viewpoint of dissipating heat, the solenoids 60 supported by the support plate 122 are mostly exposed to the air without being housed in a case.

As shown in FIG. 15, each of the solenoids 60 of this embodiment is of a so-called push-type, and includes a frame 610, a coil and a plunger (which are not shown), and a push bar 66. The solenoid 60 is configured such that the push bar 66 linearly moves in a protruding direction (upward) from the cylindrical frame 610 in interlock with a movement of the plunger when the coil is energized. The push bars 66 of the two solenoids 60 are connected by a connecting shaft 67 extending in the left-right direction.

The link mechanism 70 is configured to move the clutch sleeve 55 via the engagement arm 523 in interlock with movements of the push bars 66. As shown in FIGS. 13 to 15, the link mechanism 70 includes a rotary lever 76, a torsion spring 77, a slide member 78 and a pressing member 79.

The rotary lever 76 is a member which is generally L-shaped in a side view. The rotary lever 76 has a first arm 761 and a second arm 762 extending from one end portion of the first arm 761 in a direction crossing (generally perpendicular to) the first arm 761. The rotary lever 76 is supported on a rear end portion of the gear housing 12 via a support shaft 764 so as to be rotatable around a rotation axis extending in the left-right direction. The support shaft 764 is inserted through a connection portion between the first and second arms 761, 762. The rotary lever 76 is disposed above the solenoids 60. The first arm 761 is disposed on a side closer to the solenoids 60 than the second arm 762.

The torsion spring 77 is configured as a double torsion spring. The torsion spring 77 has a structure which is similar to that of the torsion spring 74, and has two coil parts 771, two arms 772 and a connection part 773. The coil parts 771 are fitted onto the support shaft 764 on the opposite sides of the rotary lever 76. The two arms 772 are locked to a rear end surface of the gear housing 12. The connection part 773 is arranged to be held in abutment with a front surface of the second arm 762. With such a structure, the torsion spring 77 normally biases the rotary lever 76 clockwise as viewed from the left side (clockwise in FIG. 13), that is, in a direction to turn the first arm 761 downward. When the solenoids 60 are not in operation, that is, when the push bars 66 are disposed in the lowermost position (shown in FIG. 13), the first arm 761 extends generally rearward from the support shaft 764 and is held in abutment with an upper end of a central portion of the connecting shaft 67 for the solenoids 60.

The slide member 78 has a rectangular frame-like shape and is arranged to be slidable in the front-rear direction within the recess 126 which is formed in the upper end portion of the gear housing 12. A rear end of the slide member 78 is held in abutment with a front surface of the second arm 762 of the rotary lever 76. The slide member 78 is disposed above the slide member 521 of the clutch switching mechanism 52. Further, a portion of the mode switching dial 51 is inserted through the frame-like slide member 78 (see FIG. 13). Therefore, the slide member 78 is dimensioned so as not to interfere with the mode switching dial 51 when moving in the front-rear direction.

The pressing member 79 has a pin-like shape. The pressing member 79 is arranged to be slidable in the front-rear direction in a through hole 128 which is formed in a wall part 127 (a portion of the gear housing 12) defining a front end of the recess 126. Further, an O-ring 791 is fitted in an annular groove formed in an outer periphery of the pressing member 79. The O-ring 791 serves to prevent grease from leaking out through the through hole 128 due to a sliding movement of the pressing member 79. The pressing member 79 is disposed between the slide member 78 and the engagement arm 523 of the clutch switching mechanism 52. A rear end of the pressing member 79 is held in abutment with a front end of the slide member 78. Further, when the engagement arm 523 of the clutch switching mechanism 52 is placed in the rearmost position in the hammer drill mode, a front end of the pressing member 79 is held in abutment with a rear end of the engagement arm 523.

Figure 16:
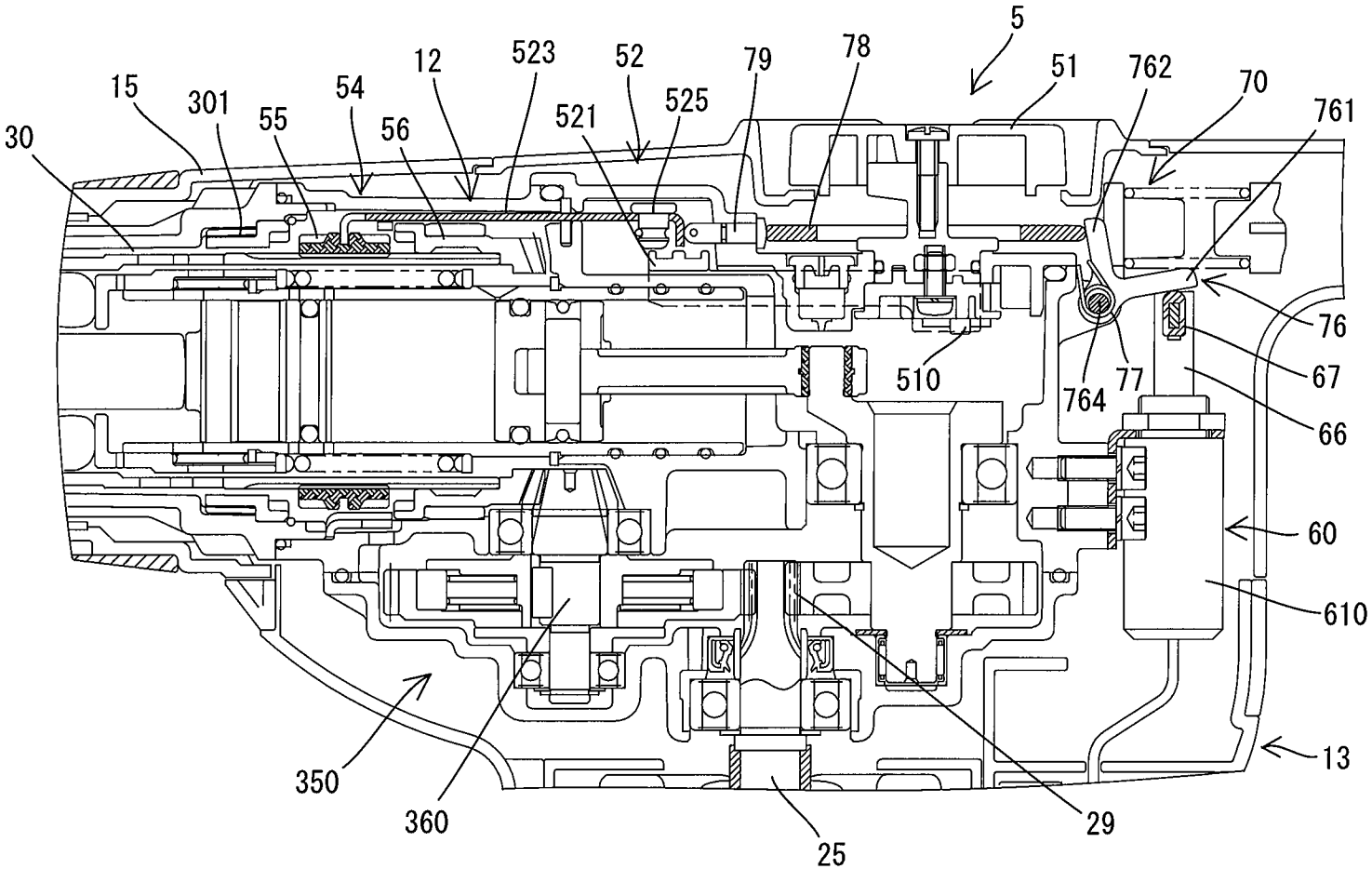
FIG. 16 is a sectional view, corresponding to FIG. 13, for illustrating operations of the solenoid, the link mechanism and the mode switching mechanism.
Figure 17:
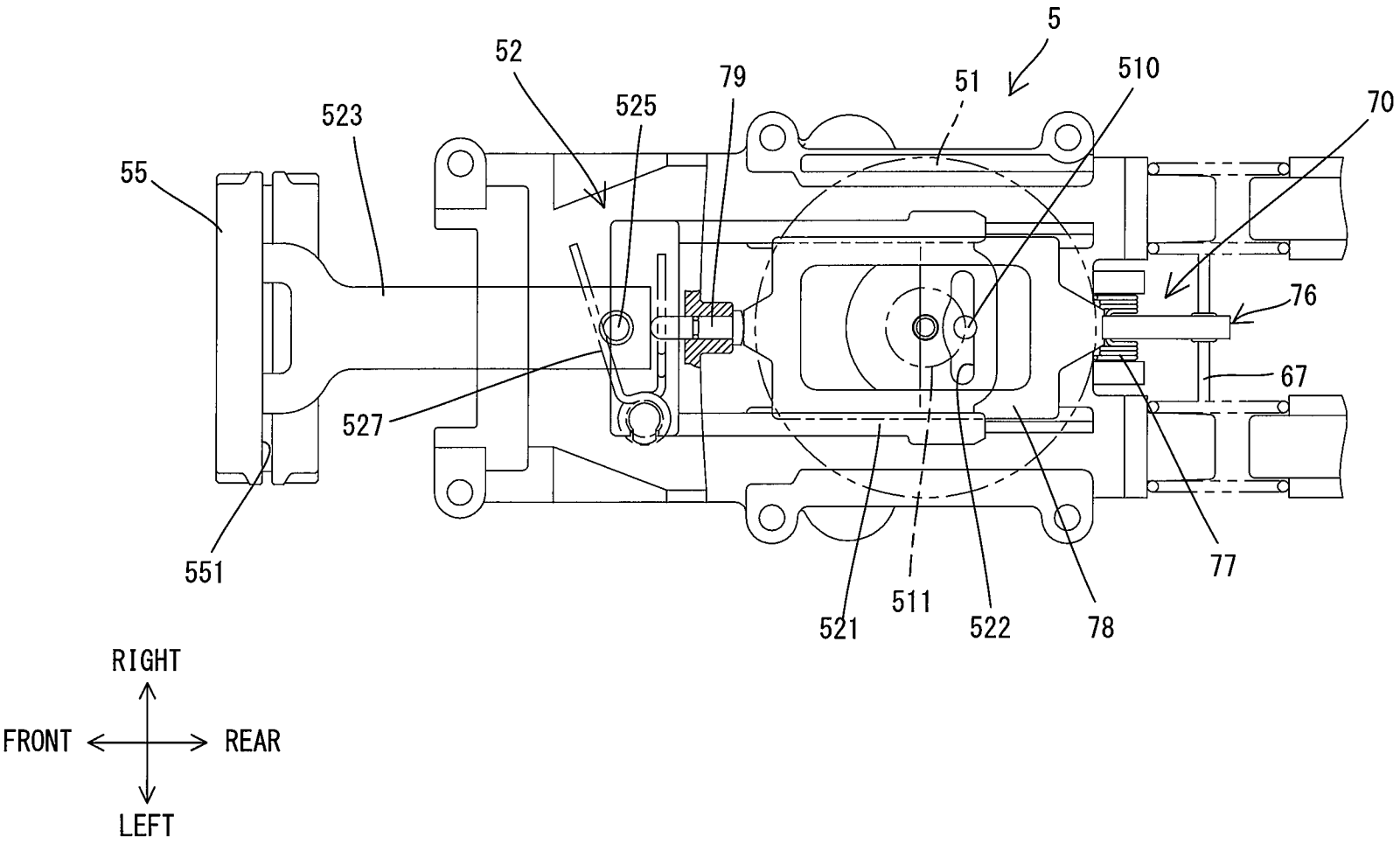
FIG. 17 is a sectional view, corresponding to FIG. 14, for illustrating operations of the link mechanism and the mode switching mechanism.

As shown in FIGS. 16 and 17, when the coil is energized, the push bars 66 of the solenoids 60 protrude upward. Thus, the connecting shaft 67 connected to the push bars 66 turns the rotary lever 76 counterclockwise as viewed from the left side (counterclockwise in FIG. 16) against the biasing force of the torsion spring 77. The second arm 762 is turned forward and moves the slide member 78, the pressing member 79 and the engagement arm 523 forward, against the biasing force of the torsion spring 527. As a result, the clutch sleeve 55 engaged with the engagement arm 523 is moved forward, away from the gear sleeve 56, so that the clutch mechanism 54 is turned to the interrupting state in which the clutch mechanism 54 is incapable of transmitting torque to the tool holder 30 (see FIG. 16).

In the meantime, the slide member 521 of the clutch switching mechanism 52, which is held by the eccentric pin 510, does not move forward in interlock with the movements of the slide member 78, the pressing member 79 and the engagement arm 523. Further, the position up to which the clutch sleeve 55 is moved forward by the operations of the solenoids 60 is set rearward of the position in which the clutch sleeve 55 is placed in the hammer mode (the position in which the clutch sleeve 55 is engaged with the lock ring 301).

Now, operations of the hammer drill 102 (particularly, interrupting torque transmission upon occurrence of a kick-back state) in the hammer drill mode is explained.

When the switch lever 171 is depressed and the switch 172 is turned on, the control circuit 91 (CPU) of the controller 9 starts driving of the motor 2. In the hammer drill mode, as described above, the clutch mechanism 54 of the mode switching mechanism 5 is held in a transmittable state in which the clutch sleeve 55 and the gear sleeve 56 are engaged with each other. Therefore, when the motor 2 is driven, the hammering operation and the drilling operation are performed.

When the control circuit 91 determines that the kickback state has occurred, the control circuit 91 actuates the solenoids 6. Then, as described above, the push bars 66 protrude upward, and the engagement arm 523 is moved forward via the link mechanism 70, so that the clutch mechanism 54 is actuated (see FIGS. 16 and 17). As a result, the torque transmission from the intermediate shaft 360 to the tool holder 30 is interrupted, and the tool holder 30 stops rotating.

Thereafter, when the switch lever 171 is released and the switch 172 is turned off, the control circuit 91 stops driving of the motor 2 and energization to the solenoids 60. The push bars 66 return to their initial positions (lowermost positions), and the rotary lever 76 is turned clockwise as viewed from the left side (clockwise in FIG. 13) to the position where the first arm 761 comes in abutment with the upper end of the connecting shaft 67, by the biasing force of the torsion spring 74. At the same time, by the biasing force of the torsion spring 527, the engagement arm 523 and the clutch sleeve 55 are moved rearward while pressing the pressing member 79 and the slide member 78 rearward. Then, the clutch sleeve 55 is engaged with the gear sleeve 56, and the clutch mechanism 40 is returned to the transmittable state (see FIGS. 13 to 15).

As described above, in this embodiment, like in the first embodiment, the clutch mechanism 54 is provided on the torque transmission path from the motor 2 to the tool holder 30 (the final output shaft). The clutch mechanism 54 is configured to be mechanically actuated via the push bars 66 of the solenoids 60 which linearly move. Therefore, like in the first embodiment, a more rational structure which is capable of interrupting torque transmission when excessive reaction torque acts on the body housing 11 can be realized, compared to a case in which an electromagnetic clutch is employed. Further, in this embodiment, the clutch mechanism 54 is provided on the tool holder 30 which rotates at lower speed than the motor shaft 25. Therefore, the torque transmission to the tool holder 30 can be properly interrupted even with the mechanical clutch mechanism 54 of which interrupting speed is not as high as an electromagnetic clutch.

Further, in this embodiment, the motion of the push bars 66 in the up-down direction is converted by the link mechanism 70 into motion of the clutch sleeve 55 of the clutch mechanism 54 in the front-rear direction. Therefore, it is not necessary to arrange the solenoids 60 and the clutch mechanism 54 side by side in the up-down direction, so that a size increase (an increase in length in the up-down direction) of the whole device can be prevented. Further, the operating direction of the push bars 66 can be easily made different from the moving direction of the clutch sleeve 55 by using the torsion spring 77 in the link mechanism 70. Therefore, in this embodiment, the solenoids 60 are disposed behind the gear housing 12. In other words, the solenoids 60 are disposed relatively close not only to the clutch mechanism 54 but to the controller 9 disposed behind the motor body 20. Thus, rational arrangement which facilitates wiring between the solenoids 60 and the controller 9 can be realized while the solenoids 60 are disposed close to the clutch mechanism 54.

Further, in the link mechanism 70 of this embodiment, the two torsion springs 77, 527 are used, and the O-ring 791 is fitted on the pressing member 79. A relatively strong force is required to move the clutch sleeve 55 against the elastic forces of these elastic members. In this embodiment, the clutch sleeve 55 can be reliably moved via the link mechanism 70 by utilizing resultant force of the two solenoids 60.

Further, in this embodiment, the clutch mechanism 54 of the mode switching mechanism 5 which is originally provided in the hammer drill 102 is actuated by the solenoids 60 when a kickback state occurs in the hammer drill mode. Specifically, the clutch mechanism 54 is actuated by the link mechanism 70 which is operated in interlock with the operation of the solenoids 60, via a different route from the clutch switching mechanism 52. Thus, by utilizing the clutch mechanism 54 of the mode switching mechanism 5, a mechanism can be realized which is capable of efficiently interrupting the torque transmission upon the occurrence of the kickback state, while suppressing the number of additional parts.

Correspondences between the features of the embodiments and the features of the invention are as follow. Each of the hammer drills 101, 102 is an example that corresponds to the "rotary tool" and the "hammer drill". The motor 2, the motor body 20, the stator 21, the rotor 23, the motor shaft 25 and the rotation axis A2 are examples that correspond to the "motor", the "motor body", the "stator", the "rotor", the "motor shaft" and the "first rotation axis", respectively. The tool holder 30 and the driving axis A1 are examples that correspond to the "final output shaft" and the "second rotation axis", respectively. The body 10 or the body housing 11 is an example that corresponds to the "housing". The acceleration sensor 93 is an example that corresponds to the "detecting mechanism". Each of the clutch mechanisms 40, 54 is an example that corresponds to the "interrupting mechanism" and the "clutch mechanism". Each of the solenoids 6, 60 is an example that corresponds to the "solenoid". Each of the plunger 63 and the push bar 66 is an example that corresponds to the "actuation part".

Each of the actuating shaft 41 and the clutch sleeve 55 is an example that corresponds to the "first clutch member". Each of the gear member 42 and the gear sleeve 56 is an example that corresponds to the "second clutch member". Each of the link mechanisms 7, 70 is an example that corresponds to the "at least one intervening member". Each of the torsion springs 74, 77, 527 is an example that corresponds to the "torsion spring". The intermediate shaft 36 and the rotation axis A3 are examples that correspond to the "intermediate shaft" and the "third rotation axis", respectively. The shaft insertion hole 366 and the ball holding hole 368 are examples that correspond to the "first hole" and the "second hole", respectively. The large-diameter part 411 and the small-diameter part 413 of the actuating shaft 41 are examples that correspond to the "large-diameter part" and the "small-diameter part", respectively. The ball 43 is an example that corresponds to the "ball". The motor housing 13 and the gear housing 12 are examples that correspond to the "first housing part" and the "second housing part", respectively. The case 64 of the solenoid 6 is an example that corresponds to the "case". The mode switching mechanism 5 is an example that corresponds to the "mode switching mechanism". The controller 9 or the control circuit is an example that corresponds to the "control part".

The above-described embodiments are described by way of example only, and a rotary tool according to the present invention is not limited to the structures of the hammer drills 101, 102 of the above-described embodiments. For example, the following modifications may be made. It is noted that one or more of these modifications may be employed in combination with any one of the hammer drills 101, 102 of the above-described embodiments or the claimed invention.

For example, in the above-described embodiments, the hammer drills 101, 102 are each described as an example of the rotary tool, but the present invention may also be applied to an electric drill which is capable of performing only the drilling operation, and to a tightening tool which is capable of tightening a nut or a bolt. The present invention may also be applied to a hammer drill, for example, having three operation modes of the hammer mode, the hammer drill mode, and a drill mode for performing only the drilling operation. In this case, the clutch mechanism 40, 54 may be actuated by the solenoid 6, 60 as described above, when a kickback state occurs in the hammer drill mode and the drill mode.

The structures of the body 10, the driving mechanism 3 and the motor 2 may also be appropriately changed or modified according to the rotary tool to which the present invention is applied. For example, the hammer drills 101, 102 of the above-described embodiments have a vibration-isolating structure for reducing transmission of vibration from the body housing 11 to the handle 17 and the outer housing 15, but such a vibration-isolating structure may be appropriately modified or may be omitted. Further, as the motion converting mechanism 31, the clunk mechanism is employed in the above-described embodiments, but a mechanism using a swinging member may be employed instead. Further, for example, the striking mechanism 33 may be changed to a mechanism of striking the tool accessory 100 only by the striker 331.

The structures of the clutch mechanisms 40, 54, the solenoids 6, 60 and the link mechanisms 7, 70 may be appropriately changed or modified. For example, the clutch mechanism 40 may be configured with a driving-side member and a driven-side member which have respective clutch teeth to be engaged with each other, without using the balls 43. The arrangement position and number of the solenoid 6, 60 and the operating direction of the plunger 63 or the push bar 66 are not limited to those of the embodiments. Further, the operation system of the solenoid (such as pull-type and push-type) may be appropriately changed. Components of the link mechanism 7, 70 and the structure, number and arrangement of the torsion spring may be appropriately changed according to the arrangement relation between the solenoid 6, 60 and the clutch mechanism 40, 54 and required force.

As the detecting mechanism for detecting the motion state of the housing, for example, a speed sensor or a displacement sensor may be employed, in place of the acceleration sensor described in the above-described embodiments. Further, in order to determine whether or not excessive reaction torque has acted on the body housing 11 (in other words, whether or not a kickback state has occurred), in addition to a detection result of such a detecting mechanism, for example, a detection result of a physical quantity corresponding to the torque acting upon the tool accessory 100 may be used.

In the hammer drill 101, 102, only one intermediate shaft 36, 360 is provided on the torque transmission path from the motor shaft 25 to the tool holder 30 (the final output shaft). In a structure having a plurality of intermediate shafts, however, the clutch mechanism 40 may be provided on any of the intermediate shafts.

Further, in view of the nature of the present invention and the above-described embodiments, the following features are provided. The features can be used in combination with any one of the hammer drills 101, 102 of the embodiments and the above-described modifications, or in combination with the claimed invention.

(Aspect 1)

The rotary tool may further include a control part configured to control an operation of the rotary tool, and the control part may be configured to actuate the actuation part of the solenoid when the control part determines that excessive reaction torque has acted on the housing, based on the motion state detected by the detecting mechanism.

(Aspect 2)

The intermediate shaft may be arranged in parallel to the motor shaft.

(Aspect 3)

The detecting mechanism may be configured to detect, as the motion state, a physical quantity relating to a state of rotation of the housing around the second rotation axis.

DESCRIPTION OF THE NUMERALS

100: tool accessory; 101, 102: hammer drill; 10: body; 11: body housing; 12: gear housing; 121: rear wall; 122: support plate; 125: arm part; 126: recess; 127: wall; 128: through hole; 13: motor housing; 130: peripheral wall; 131: inner wall; 132: rear wall part; 15: outer housing; 151: rear wall; 17: handle; 170: grip part; 171: switch lever; 172: switch; 173: connection part; 174: connection part; 175: elastic member; 176: elastic member; 19: power cable; 2: motor; 20: motor body; 21: stator; 23: rotor; 25: motor shaft; 29: driving gear; 3: driving mechanism; 30: tool holder; 301: lock ring; 31: motion converting mechanism; 311: crank shaft; 313: connecting rod; 315: piston; 317: cylinder; 33: striking mechanism; 331: striker; 333: impact bolt; 335: air chamber; 35, 350: rotation transmitting mechanism; 36, 360: intermediate shaft; 361: driven gear; 363: small bevel gear; 366: shaft insertion hole; 368: ball holding hole; 40: clutch mechanism; 41: actuating shaft; 411: large-diameter part; 413: small-diameter part; 42: gear member; 421: driven gear; 423: ball holding groove; 43: ball; 5: mode switching mechanism; 51: mode switching dial; 510: eccentric pin; 511: locus; 52: clutch switching mechanism; 521: slide member; 522: elongate hole; 523: engagement arm; 525: connection pin; 527: torsion spring; 54: clutch mechanism; 55: clutch sleeve; 551: annular groove; 56: gear sleeve; 561: large bevel gear; 6, 60: solenoid; 61, 610: frame; 62: coil; 63: plunger; 631: cap; 64: case; 66: push bar; 67: connecting shaft; 7, 70: link mechanism; 71: rotary shaft; 72: first arm part; 73: second arm part; 74: torsion spring; 741: coil part; 742: arm; 743: connection part; 76: rotary lever; 761: first arm; 762: second arm; 764: support shaft; 77: torsion spring; 771: coil part; 772: arm; 773: connection part; 78: slide member; 79: pressing member; 791: O-ring; 9: controller; 91: control circuit; 93: acceleration sensor; 97: wiring; A1: driving axis; A2: rotation axis; A3: rotation axis

What is claimed is:

1. A rotary tool, comprising:

a housing;

a motor disposed within the housing that includes a motor body and a motor shaft, the motor body including a stator and a rotor, the motor shaft extending from the rotor and configured to be rotatable around a first rotation axis;

a final output shaft supported to be rotatable around a second rotation axis relative to the housing, and configured to be rotationally driven by torque transmitted from the motor shaft;

a detecting mechanism configured to detect a motion state of the housing;

an interrupting mechanism provided between the motor shaft and the final output shaft, the interrupting mechanism being configured to interrupt transmission of the torque from the motor shaft to the final output shaft while the final output shaft remains rotatable relative to the housing; and a solenoid including a linearly movable actuation part and configured to mechanically actuate the interrupting mechanism via the actuation part based on the motion state of the housing detected by the detecting mechanism, at least a portion of the solenoid being housed in a plastic case mounted to the housing.

2. The rotary tool as defined in claim 1, wherein:

the interrupting mechanism is configured as a mechanical clutch mechanism including a first clutch member and a second clutch member, the interrupting mechanism is configured to interrupt the transmission of the torque by a movement of the first clutch member from a transmitting position to an interrupting position, the first clutch member in the transmitting position enabling transmission of the torque by the first and second clutch members, and the first clutch member in the interrupting position disabling the transmission of the torque by the first and second clutch members, the rotary tool further includes at least one intervening member disposed between the actuation part and the first clutch member, the solenoid is configured to move the first clutch member from the transmitting position to the interrupting position via the at least one intervening member, and an operating direction of the actuation part and a moving direction of the first clutch member cross each other.

3. The rotary tool as defined in claim 2, further comprising:

at least one torsion spring, wherein:

when the solenoid is not in operation, the at least one intervening member is held in an initial position by a biasing force of the at least one torsion spring so that the first clutch member is disposed in the transmitting position, and when the solenoid is operated, the actuation part moves the at least one intervening member from the initial position against the biasing force of the at least one torsion spring and thereby moves the first clutch member to the interrupting position.

4. The rotary tool as defined in claim 2, further comprising:

an intermediate shaft disposed between the motor shaft and the final output shaft, the intermediate shaft being configured to rotate around a third rotation axis, and the intermediate shaft having a first hole and a second hole, the first hole extending along the third rotation axis, the second hole extending through the intermediate shaft in a direction crossing the third rotation axis, wherein the clutch mechanism includes:

the first clutch member formed in a shaft-like shape having a large-diameter part and a small-diameter part, the first clutch member being disposed to be movable along the third rotation axis within the first hole;

the second clutch member disposed radially outward of and coaxially with the intermediate shaft; and a ball disposed within the second hole and between the first clutch member and the second clutch member in a radial direction of the intermediate shaft, when the solenoid is not in operation, the first clutch member is disposed in the transmitting position in which the large-diameter part faces the ball so that the intermediate shaft and the second clutch member integrally rotate while combined with each other via the ball, thereby transmitting the torque, and when the solenoid is operated, the first clutch member is moved along the third rotation axis to the interrupting position in which the small-diameter part faces the ball so that the second clutch member is allowed to rotate relative to the intermediate shaft, thereby interrupting the transmission of the torque.

5. The rotary tool as defined in claim 2, wherein the at least one intervening member includes a plurality of intervening members.

6. The rotary tool as defined in claim 2, wherein:

the rotary tool is a hammer drill configured to operate according to a selected one of a plurality of operation modes, the rotary tool further includes a mode switching mechanism provided on the final output shaft, the switching mechanism being configured to switch between a first state and a second state according to the selected operation mode, transmission of the torque to the final output shaft being enabled in the first state and disabled in the second state, and the clutch mechanism comprises a portion of the mode switching mechanism.

7. The rotary tool as defined in claim 1, further comprising:

an intermediate shaft disposed between the motor shaft and the final output shaft on, the intermediate shaft being configured to rotate around a third rotation axis, wherein the interrupting mechanism is provided on the intermediate shaft and configured to interrupt transmission of the torque from the motor shaft to the intermediate shaft.

8. The rotary tool as defined in claim 1, wherein:

the first rotation axis of the motor shaft crosses the second rotation axis of the final output shaft, the housing includes a first housing part that houses the motor body and a second housing part that houses the final output shaft, and the solenoid is disposed between the second housing part and the motor body and within a range of a length of the motor shaft in an extending direction of the first rotation axis.

9. A rotary tool, comprising:

a motor including a motor body and a motor shaft, the motor body including a stator and a rotor, the motor shaft extending from the rotor and configured to be rotatable around a first rotation axis;

a final output shaft configured to be rotationally driven around a second rotation axis by torque transmitted from the motor shaft;

a housing that houses the motor and the final output shaft;

a detecting mechanism configured to detect a motion state of the housing;

a mechanical clutch mechanism provided on a transmission path of the torque from the motor shaft to the final output shaft and including a first clutch member and a second clutch member;

a solenoid including a linearly movable actuation part and configured to mechanically actuate the clutch mechanism via the actuation part based on the motion state of the housing detected by the detecting mechanism; and at least one intervening member disposed between the actuation part and the first clutch member, wherein:

the clutch mechanism is configured to interrupt the transmission of the torque by a movement of the first clutch member from a transmitting position to an interrupting position, the first clutch member in the transmitting position enabling transmission of the torque by the first and second clutch members, and the first clutch member in the interrupting position disabling the transmission of the torque by the first and second clutch members, and the solenoid is configured to move the first clutch member from the transmitting position to the interrupting position via the at least one intervening member.

10. The rotary tool as defined in claim 9, wherein an operating direction of the actuation part and a moving direction of the first clutch member cross each other.

11. The rotary tool as defined in claim 9, further comprising:

at least one torsion spring, wherein:

when the solenoid is not in operation, the at least one intervening member is held in an initial position by a biasing force of the at least one torsion spring so that the first clutch member is disposed in the transmitting position, and when the solenoid is operated, the actuation part moves the at least one intervening member from the initial position against the biasing force of the at least one torsion spring and thereby moves the first clutch member to the interrupting position.

12. The rotary tool as defined in claim 9, further comprising:

an intermediate shaft disposed between the motor shaft and the final output shaft on the transmission path, the intermediate shaft being configured to rotate around a third rotation axis, wherein the clutch mechanism is provided on the intermediate shaft and configured to interrupt transmission of the torque from the motor shaft to the intermediate shaft.

13. The rotary tool as defined in claim 12, wherein:

the intermediate shaft has a first hole and a second hole, the first hole extending along the third rotation axis, the second hole extending through the intermediate shaft in a direction crossing the third rotation axis, the clutch mechanism includes:

the first clutch member formed in a shaft-like shape having a large-diameter part and a small-diameter part, the first clutch member being disposed to be movable along the third rotation axis within the first hole;

the second clutch member disposed radially outward of and coaxially with the intermediate shaft; and a ball disposed within the second hole and between the first clutch member and the second clutch member in a radial direction of the intermediate shaft, when the solenoid is not in operation, the first clutch member is disposed in the transmitting position in which the large-diameter part faces the ball so that the intermediate shaft and the second clutch member integrally rotate while combined with each other via the ball, thereby transmitting the torque, and when the solenoid is operated, the first clutch member is moved along the third rotation axis to the interrupting position in which the small-diameter part faces the ball so that the second clutch member is allowed to rotate relative to the intermediate shaft, thereby interrupting the transmission of the torque.

14. The rotary tool as defined in claim 9, wherein the at least one intervening member includes a plurality of intervening members.

15. The rotary tool as defined in claim 9, wherein:

the first rotation axis of the motor shaft crosses the second rotation axis of the final output shaft, the housing includes a first housing part that houses the motor body and a second housing part that houses the final output shaft, and the solenoid is disposed between the second housing part and the motor body and within a range of a length of the motor shaft in an extending direction of the first rotation axis.

16. The rotary tool as defined in claim 9, wherein at least a portion of the solenoid is housed in a plastic case mounted to the housing.

17. The rotary tool as defined in claim 9, wherein:

the rotary tool is a hammer drill configured to operate according to a selected one of a plurality of operation modes, the rotary tool further includes a mode switching mechanism provided on the final output shaft, the switching mechanism being configured to switch between a first state and a second state according to the selected operation mode, transmission of the torque to the final output shaft being enabled in the first state and disabled in the second state, and the clutch mechanism comprises a portion of the mode switching mechanism.

18. The rotary tool as defined in claim 17, further comprising:

a control part configured to control an operation of the rotary tool, wherein:

the second rotation axis of the final output shaft extends in a front-rear direction of the rotary tool, the first rotation axis of the motor shaft crosses the second rotation axis, the housing includes a first housing part that houses the motor body and the control part and a second housing part that houses the final output shaft, the control part is disposed rearward of the motor body within the first housing part, and the solenoid is disposed rearward of the second housing part.

19. The rotary tool as defined in claim 9, further comprising:

another solenoid, wherein:

the two solenoids are configured to move the first clutch member via the at least one intervening member by resultant force of the two solenoids.

* * * * *